US011015341B2

(12) United States Patent
Schafer-Vinson

(10) Patent No.: US 11,015,341 B2
(45) Date of Patent: May 25, 2021

(54) PRE-FINISHED LOG WALL PANEL SYSTEM

(71) Applicant: Edgewood, Athol, ID (US)

(72) Inventor: Brian Schafer-Vinson, Athol, ID (US)

(73) Assignee: Edgewood, Athol, ID (US)

( * ) Notice: Subject to any disclaimer, the term of this patent is extended or adjusted under 35 U.S.C. 154(b) by 0 days.

(21) Appl. No.: 16/534,923

(22) Filed: Aug. 7, 2019

(65) Prior Publication Data

US 2021/0040734 A1 Feb. 11, 2021

(51) Int. Cl.
*E04B 2/70* (2006.01)
*E04B 1/41* (2006.01)

(52) U.S. Cl.
CPC ..... *E04B 2/702* (2013.01); *E04B 1/40* (2013.01)

(58) Field of Classification Search
CPC . E04B 2/702; E04B 2/701; E04B 2/70; E04B 2001/2668; E04B 2001/3583
See application file for complete search history.

(56) References Cited

U.S. PATENT DOCUMENTS 1,813,455 A * 7/1931 Lawton ..... E04B 2/702 52/233
2,101,542 A * 12/1937 Hartzell ..... B27M 1/02 144/380
4,606,388 A * 8/1986 Favot ..... B27K 3/20 144/361
7,661,230 B2 * 2/2010 Peaco ..... E04B 1/10 144/359
8,341,898 B1 * 1/2013 Mizia ..... E04F 13/0733 52/233
2002/0046519 A1 * 4/2002 Houseal ..... E04B 2/702 52/233
2002/0088200 A1 * 7/2002 Chambers ..... E04B 2/702 52/747.1
2004/0134142 A1 * 7/2004 Stutts ..... E04B 2/702 52/233
2004/0163358 A1 * 8/2004 Clarke ..... E04B 2/702 52/782.1
2006/0248825 A1 * 11/2006 Garringer ..... E04B 2/705 52/233
2008/0256823 A1 * 10/2008 Knorr ..... B27M 1/02 34/399
2009/0133345 A1 * 5/2009 Wrightman ..... E04B 2/702 52/233

(Continued)

FOREIGN PATENT DOCUMENTS

DE 3804525 A1 * 8/1989 ..... E04B 2/702
WO WO-9701682 A1 * 1/1997 ..... E04B 5/12

OTHER PUBLICATIONS

Montana Specialty Log Construction, "Cabins," retreived Aug. 2, 2019, www.mtspecialtylogconstruction.com/cabins.html, 3 pages.

*Primary Examiner* — Christine T Cajilig
(74) *Attorney, Agent, or Firm* — Davis Wright Tremaine LLP

(57) ABSTRACT

A plurality of wood logs are arranged to form a vertical stack of horizontally extending logs, each wood log including a plurality of apertures that form a plurality of vertically aligned apertures in the vertical stack when aligned. The plurality of connector assemblies connect the plurality of wood logs together in the vertical stack. Each connector assembly of the plurality of connector assemblies extends through a corresponding one of the plurality of vertically aligned apertures.

30 Claims, 12 Drawing Sheets

(56) References Cited

U.S. PATENT DOCUMENTS

| | | | | |
|---|---|---|---|---|
| 2012/0031025 | A1* | 2/2012 | Cox | E04B 2/702<br>52/220.1 |
| 2016/0040933 | A1* | 2/2016 | Stanish | F26B 25/22<br>34/427 |

* cited by examiner

PRE-FINISHED LOG WALL PANEL SYSTEM

BACKGROUND

Field of the Invention

The present invention is directed generally to a system for constructing and installing horizontal log walls.

Description of the Related Art

Structures built using horizontal log wall system are typically stacked at manufacturing facility one at a time in an alternating and interlocking pattern using notches at ends of each log cut to fit a perpendicularly arranged log of another wall. Consequently, this method of building log structures can be a time-consuming and expensive process. This method of constructing horizontal log wall structures also suffers from several other drawbacks. For example, each log in the structure has varying moisture content and grain density. In almost all cases humidity level at the building site is different to the humidity at harvesting and manufacturing facility. This, coupled with compression of wood fibers that results as the roof of the structure is loaded with heavy building materials and snow, causes logs to settle unpredictably. Uneven settling and compression of the structure, and uncontrollable and undesirable cracking of wall logs, is the final result of this traditional building process. Furthermore, constructing log structures onsite in this manner can be costly because as skilled labor and specialized tools may need to be brought in from a distance and unexpected weather and site constraints can hamper construction efforts. Many log home construction projects go over budget due to the specialized nature of this building medium. The budget, as well as the structural and aesthetic elements of the project, are all negatively impacted by this aspect in the traditional method.

BRIEF DESCRIPTION OF THE SEVERAL VIEWS OF THE DRAWING(S)

DETAILED DESCRIPTION OF THE INVENTION

Techniques and systems described below alleviate the disadvantages described above with the traditional methods of horizontal wall systems. Benefits arising from the techniques and systems of the present disclosure include that fixed budget can be provided, on site construction time for certain phases of work can be cut by up to 80%, major elements of the construction and finishing of the specialized log building systems can be completed by highly skilled craftsmen at the factory, buildings built using the described log wall panels are protected from settling or compression issues, and the log wall panels can be certified to be insect/larvae/mold/mildew free.

Figure 1:
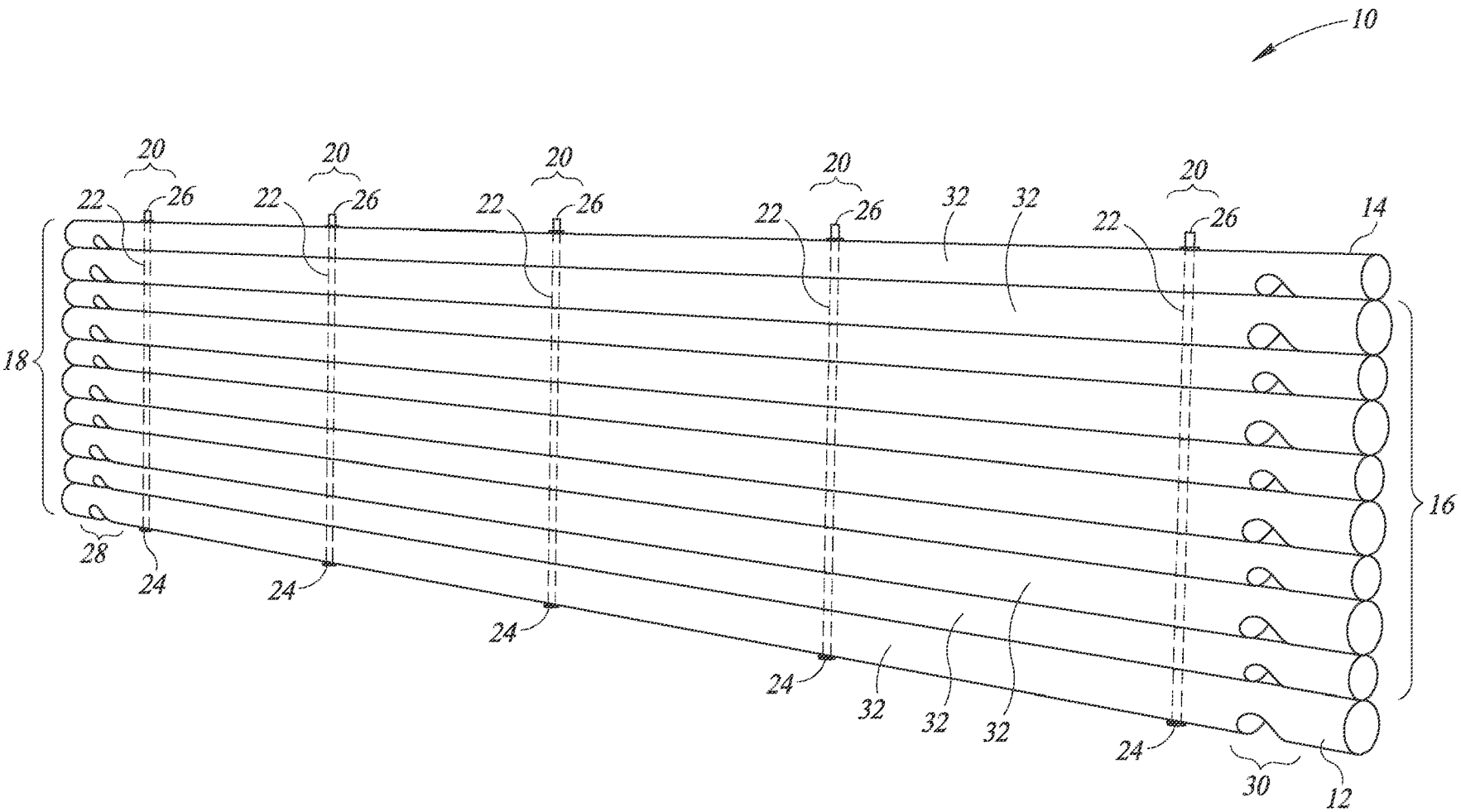
FIG. 1 is a perspective view of a log wall panel in a pre-assembled state in accordance with an embodiment of the present disclosure.

FIG. 1 depicts a log wall panel 10 of an embodiment of the present disclosure in a pre-assembled state. As depicted in FIG. 1, the log wall panel 10 may be comprised of a plurality of logs; including lowest horizontal log (also referred to as a sill log) 12, a highest horizontal log 14 (also referred to as plate log), and one or more intermediate logs 16 forming a stack of logs 18. The stack of logs 18 may be held together in a planar orientation by a plurality of connector assemblies 20, which may comprise elongated connector members 22, lower securement members 24 attached to a lower end of the elongated connector members and located at a lower portion of the lower end log 12 to secure the lower end of the stack of logs, and a upper securement members 26 attached to a upper end of the elongated connector members and located at an upper portion of the upper end log 14 to secure the upper end of the stack of logs. In some embodiments, the individual logs of the plurality of logs have no notches or plurality of notches. For example, the log wall panel 10 depicted in FIG. 1 has a plurality of left-end notches 28 and a plurality of right-end notches 30. Alternatively, one or both ends of the log wall panel may lack notches, for example, so as to be configured to be abutted against a vertical log or timber post.

The log wall panel 10 may be constructed by stacking, one at a time onto the plurality of connector assemblies 20, the sill log 12, next the one or more intermediate logs 16, and, lastly, the plate log 14, to form the stack of logs 18. In some embodiments, individual logs of the log wall panel 10 are made of wood (wood logs). In some examples, "log" refers to a portion or length of a trunk or of a large limb of a felled tree. For ease of illustration and as shown in FIG. 2, individual logs 32 of the log wall panel 10 will be described as having a length that extends along a longitudinal direction (L), and a height that extends in a transverse direction (T) to and substantially orthogonal to longitudinal direction (L).

The individual logs of the log wall panel 10 may include bark from the felled trees that produced the individual logs. In some embodiments, the individual logs of the log wall panel 10 are roughly cylindrical in accordance with the shape of the felled trees that produced the individual logs. In another embodiment logs are uniformly cylindrical in dimension in the transverse direction along its longitudinal direction. It must be noted that although the various figures of the present disclosure depict logs having a circular cross section, it is contemplated that techniques of the present disclosure are also applicable to logs having a rectangular or semi rectangular (e.g., squared timbers, D-shaped timbers, etc.) cross section. Likewise, although the various figures depict logs with flat ends, it is contemplated that the techniques of the present disclosure are applicable to logs with rounded ends, conical end, or ends of other shapes. Although FIG. 1 depicts a windowless and door-less log wall panel 10, it is contemplated, as will be described herein, that other variations (e.g., with doors, windows, and electrical cutouts) are within the scope of the present disclosure.

The stack of logs 18 may be arranged as a vertical stack of horizontally extending logs. In a typical implementation, the stack of logs 18 includes the sill log 12, the top plate log 14, and eight intermediate logs 16. The width of the individual logs comprising the stack of logs 18 may vary; for example, FIG. 1 illustrates the logs having alternating larger and smaller widths. However, the particular arrangement of the individual logs within the stack, by width or other characteristic, may depend on the type of building structure the log wall panel 10 will be installed into, on personal preference, or on structural considerations.

Figure 2:
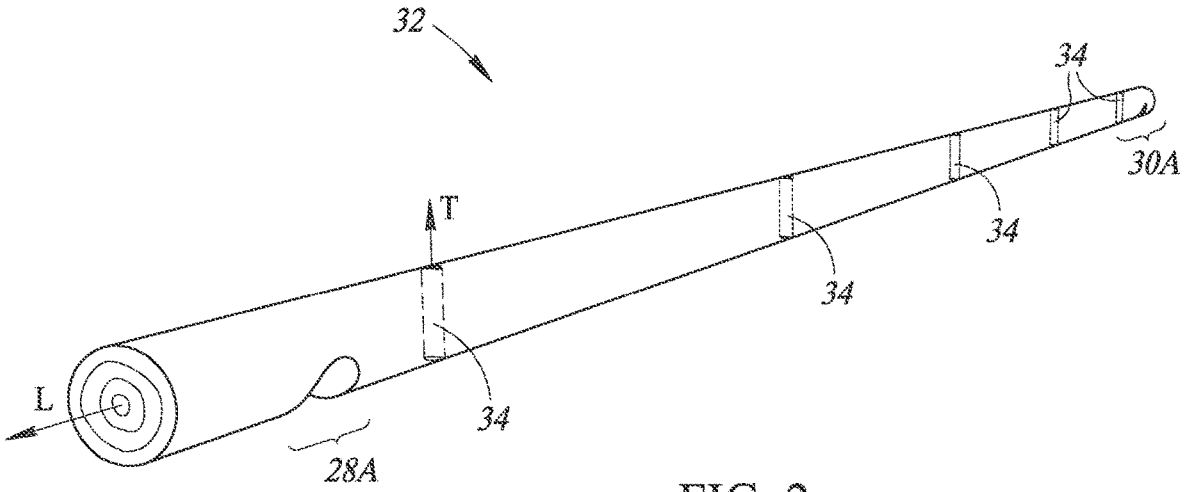
FIG. 2 is perspective view of a single log of a wall panel in accordance with an embodiment of the present disclosure.

The elongated connector members 22 may be pipes, threaded or non-threaded rods, or bars extending in the transverse direction T through aligned apertures (e.g., the plurality of apertures 34 aligned in the stack of logs 18 as shown in FIG. 2) of the stack of logs 18. Thus, in some embodiments, the elongated connector members have circular cross-sections, whereas in other embodiments, the elongated connector members have rectangular (e.g., squared) cross sections. In some embodiments, the elongated connector members 22 include internal or external threads or other securement characteristics that allow the upper securement members 26 and/or lower securement members 24 to be attached at a selected longitudinal position to the elongated connector members 22.

For example, the elongated connector members 22 may be schedule 80, three to four inch metal pipes of suitable length for the log wall panel, the elongated connector member further having internal threads that allow the upper securement members 26 with external threads to be threadably attached to an upper end portion of the elongated connector members 22. Likewise, the elongated connector members 22 may, additionally or alternatively, allow the lower securement members 24 with external threads to be threadably attached to a lower end portion of the elongated connector members 22 having internal threads.

As another alternative example, the elongated connector members 22 may be rods with external threads at upper end portions thereof that allow the upper securement members 26 with internal threads to be threadably attached to the elongated connector members at the upper end portions of the elongated connector members. Additionally or alternatively, the elongated connector members 22 may have external threads at lower end portions thereof that allow the lower securement members 24 with internal threads to be threadably attached to the elongated connector members at the lower end portions of the elongated connector members. Various combinations are possible; for example, the elongated connector member may have external threads at the upper end and internal threads at the lower end, or vice versa, and correspondingly the upper securement members may be internally threaded and the lower securement members may be externally threaded, or vice versa, as would be needed to threadably attach the elongated connector member to the upper and lower securement members. The material comprising the plurality of connector assemblies 20 may be a metal, such as iron, steel, composite, or other material suitable to hold the logs of the log wall panel together and, in some cases, provide additional load-bearing, supporting lateral integrity of the log wall panel 10 when it is installed in a building structure.

The lower securement members 24 may be flanges or other type of securement member attachable to a lower end portion of the elongated connector members 22 to securely retain the lower end log 12 on the elongated connector members 22, thereby securing the lower end log 12 to the stack of logs 18. Similarly, the upper securement members 26 may be a flange or other type of securement member attachable to the upper end of the elongated connector members 22 and securely retain the upper end log 14 on the elongated connector members 22, thereby securing the upper end log 14 to the stack of logs 18. For example, the flange may be a rectangular profile between three to four inches wide and approximately eight inches long and configured to thread onto the lower end of the elongated connector members 22 (e.g., pipes).

In some embodiments, the lower securement members 24 and/or the upper securement members 26 recessed into the respective lower end log 12 and/or upper end log 14 such that the lower securement members is attached to the elongated connector members 22 at a lower portion of the lower end log (e.g., without extending downward beyond the lower surface of the lower end log) and/or the upper securement members 26 are attached to the elongated connector members at an upper portion of the upper end log to reduce the extension of the upper securement member above the upper surface of the upper end log.

In some embodiments, the lower securement members 24 are permanently affixed to the elongated connector members 22. For example, the lower securement members 24 may be welded to the lower end portion of the elongated connector members 22 or may simply be a widened portion of the elongated connector members 22 such that the lower end log 12 is securely retained as part of the stack of logs 18 of the elongated connector members.

A plurality of left-end notches 28 may be formed on a lower portion (as depicted in FIG. 1) and/or upper portion of the individual logs comprising the stack of logs 18. The plurality of left-end notches 28 in FIG. 1 are downward facing and located at a left-end portion of the logs of the log wall panel 10. The plurality of left-end notches 28 may be configured to attach to another log wall panel similar to the log wall panel 10. For example, the plurality of left-end notches 28 may be corner joint to attach to the other log wall panel at the notches of the other log wall panel, when the logs of the panels are oriented perpendicular to each other, or at some other non-parallel angle. A plurality of right-end notches 30 may be formed on a lower portion and/or upper portion of the individual logs comprising the stack of logs 18. The plurality of right-end notches 30 inward from the right end of the logs in FIG. 1 are downward facing and located at a right-end portion of the logs of the wall panel 10 inward from the right end of the logs. Similar to the plurality of left-end notches 28, the plurality of right-end notches 30 may be configured to attach to another log wall panel similar to the log wall panel 10.

It is noted that the reference directions "left" and "right" are provided for ease of illustration only, and whether the notches appear on the left or right end of a log wall panel 10 may be dependent upon the perspective of the observer. Furthermore, although the log wall panel 10 is depicted in FIG. 1 as having both a plurality of left-end notches 28 and a plurality of right-end notches 30, it is contemplated that some log wall panels of the present disclosure may have notches only on one end portion, notches on only a portion of one end, or no notches at all.

FIG. 2 depicts an individual log 32 in accordance with an embodiment of the present disclosure. The individual log 32 may be one of a plurality of logs that form the stack of logs 18 depicted in FIG. 1. As depicted in FIG. 2, the individual log 32 may include a plurality of apertures 34. In some embodiments, the individual log 32 include one or more notches, such as the left-end notch 28 and/or the right-end notch 30.

The plurality of apertures 34 are milled into the individual log 32 to form an elongated aperture running in the transverse direction T and may also pass through the longitudinal axis L. Each of the plurality of apertures 34 may be milled to a width that is sufficient to allow the elongated connector members 22 to pass through the aperture, and provide for a "friction" fit. For example, the diameter of the aperture may be of a size sufficient to allow an elongated connector member to pass through tightly, thereby establishing a "friction" relationship between an exterior surface of the elongated connector member and the interior surface of the aperture; a benefit imparted by the friction relationship being that the elongated connector members may thereby contribute substantially to the structural integrity of the log wall panel 10, both laterally and vertically, in that way further safeguard the log wall panel from settling or compressing.

The left-end notch 28 and right-end notch 30 may be a notch that is shaped so as to fit over another individual log intersecting the individual log 32. The left-end notch 28 and right-end notch 30 may be downward facing and thus open at the lateral sides of the individual log 32. Although the figures depict the notches as being open at the lower end of the individual log 32, it is contemplated that either or both the left-end notch 28 or right-end notches 30 may alternatively be upward facing. Furthermore, it is contemplated that in some embodiments, either or both end portions of the individual log 32 could have both downward and upward facing notches at the upper and the lower end, respectively, of the log. Moreover, in some embodiments, individual logs 32 of the stack of logs 18 have notches on one end portion (but not on the other end portion) or no notches altogether. Although the figures depict round notches, it is also contemplated that the notches may be some other shape, such as saddle notches, diamond, shrink to fit, rectangular, triangular, dovetail, or other notch shape and their variations (e.g., blind, half, housed, etc.). Likewise, although FIG. 2 depicts the left-end notch 28 and right-end notch 30 of the individual log as being located inward from the longitudinal end of the individual log 32, it is contemplated that the left-end notch 28 and/or right-end notches 30 may be located at the longitudinal end and hence open longitudinally outward.

Figure 3:
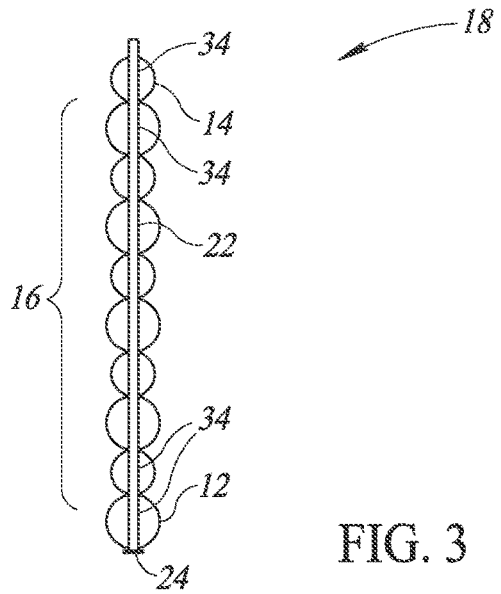
FIG. 3 is a cross-sectional end view of a log wall panel in accordance with an embodiment of the present disclosure.

FIG. 3 depicts a cross-sectional end view of the log wall panel 10 with the stack of logs 18. The stack of logs 18 may have a plurality of aligned apertures 34, such as the illustrated plurality of apertures that are aligned with apertures in corresponding positions in each other log in the stack, such that when the plurality of logs are arranged as the stack of logs 18, corresponding located ones of the apertures are coaxially aligned to allow the elongated connector members 22 to be inserted so as to connect together the stack of logs 18 and retain the stack of logs 18 in an upright orientation. The stack of logs 18 may be dried in the upright orientation depicted in FIG. 3, such as in a drying kiln 48 shown in FIGS. 6 and 8, while simultaneously being subjecting the stack of logs 18 to a vertical load.

Figure 4:
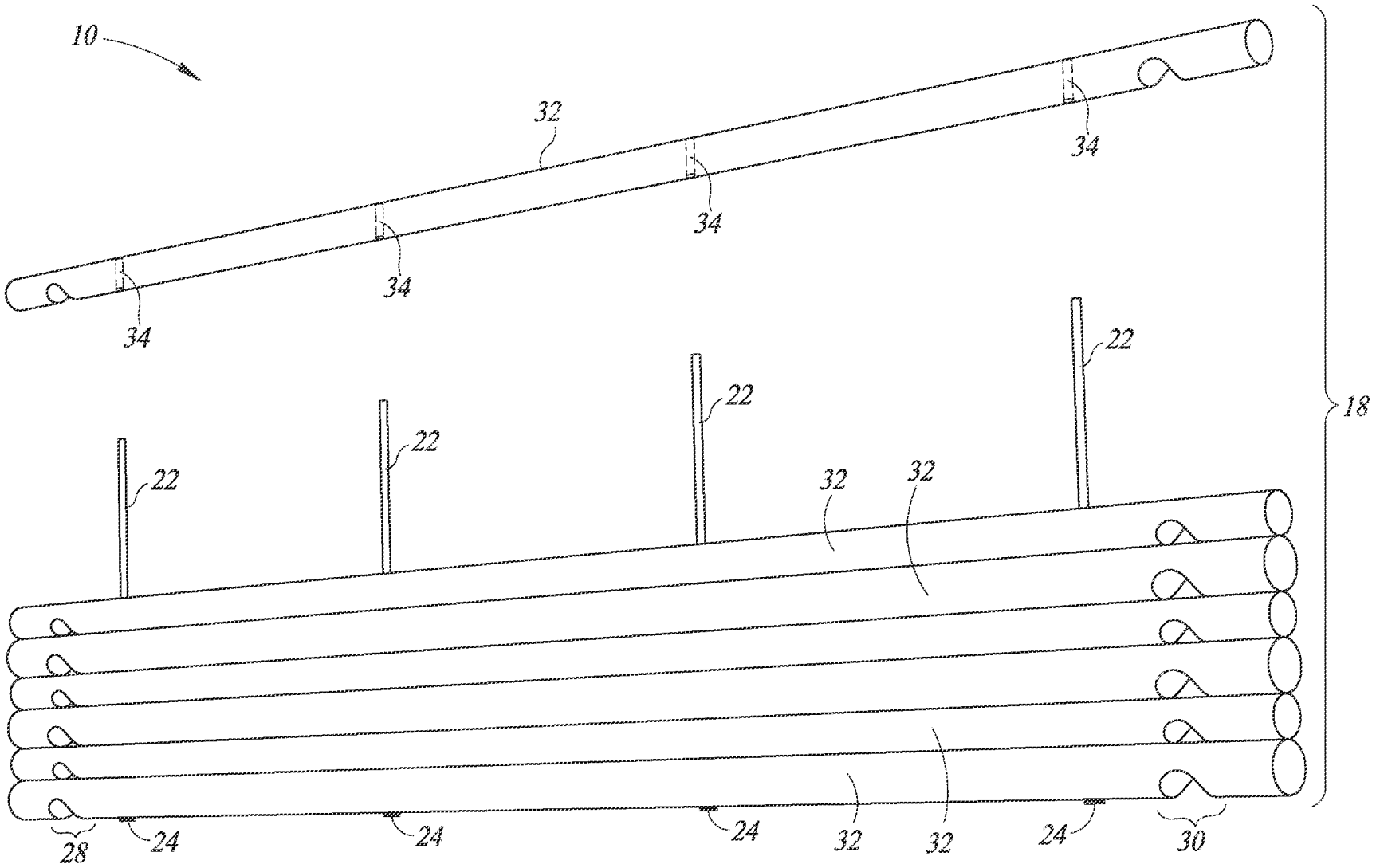
FIG. 4 is a perspective view illustrating assembly of a log wall panel by sliding logs onto perpendicular pipes in accordance with an embodiment of the present disclosure.

FIG. 4 depicts the log wall panel 10 in a partially assembled state to illustrate how the log wall panel is assembled by stacking individual logs, such as the individual log 32, to form the stack of logs 18. As can be seen in FIG. 4, the stack of logs 18 may begin with a plurality of elongated connector members 22, each having one of the lower, securement members 24 attached at its lower-end portion. As shown in FIGS. 2 and 3, each of the plurality of logs may have a plurality of apertures 34 (not illustrated in FIG. 4) through which the plurality of elongated connector members 22 may be inserted. Furthermore, each of the plurality of apertures 34 of one log of the plurality of logs may be configured to align with another log of the plurality of logs such that the plurality of apertures align to form a plurality of coaxially aligned apertures in the stack of logs 18 when the plurality of logs are arranged to form the stack of logs 18.

Thus, a first individual log 32A may be slid onto the elongated connector members 22 via the plurality of apertures 34 of the first individual log to become the lower end log (sill log) 12. The lower end log 12 is securely retained by the plurality of lower securement members 24. For example, in some embodiments, the plurality of lower securement members 24 are sized larger than the plurality of apertures of the lower end log 12 so as to be unable to pass through those apertures. The one or more intermediate logs 16 may be slid onto the plurality of elongated connector members 22, followed by the upper end log 14, in a similar manner, thereby forming the stack of logs 18. It is noted that the upper securement members 26 depicted in FIG. 1 may not be affixed to the elongated connector members 22 at least until all of the one or more intermediate logs 16 and the upper end log 14 are slid onto the elongated connector members 22. In some embodiments, the upper securement members 26 are not affixed until after the log wall panel 10 is dried and/or compressed, such as in the manner depicted in FIGS. 6 and 8. In some embodiments, one or more of the plurality of logs may have no notches or plurality of notches, such as the left-end notch 28 and left-end notch 28 depicted in FIG. 4.

It is noted that terms "bottom," "top," "upper," "lower," "left," and "right" may be used in the present disclosure as an aid to understanding the respective figures, and that in an alternate implementation, the directions may not correspond to the directions depicted. For example, in an alternate implementation, the stack of logs 18 can be formed in a horizontal position rather than a vertical position, in which case the "lower" end log may be a rightmost or leftmost log (depending on the perspective of the observer).

Figure 5:
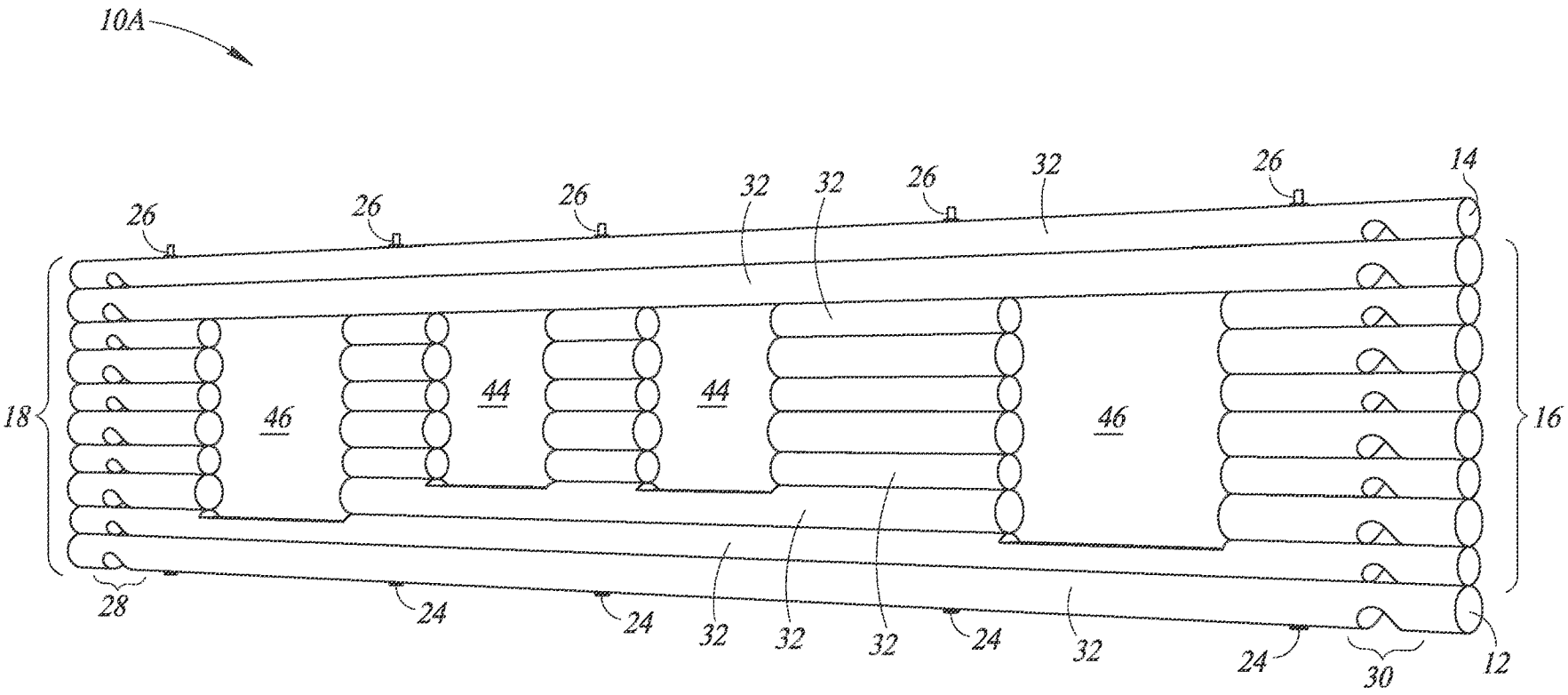
FIG. 5 is a perspective view of assembled log wall panel with window and door openings cutout ready for compression and drying process of the present disclosure.

FIG. 5 depicts a variation of the log wall panel 10, indicated as an exemplary log wall panel 10A shown with window cutouts, shown in FIG. 5 as small window openings 44 and large window openings 46 of an embodiment of the present disclosure.

Figure 8:
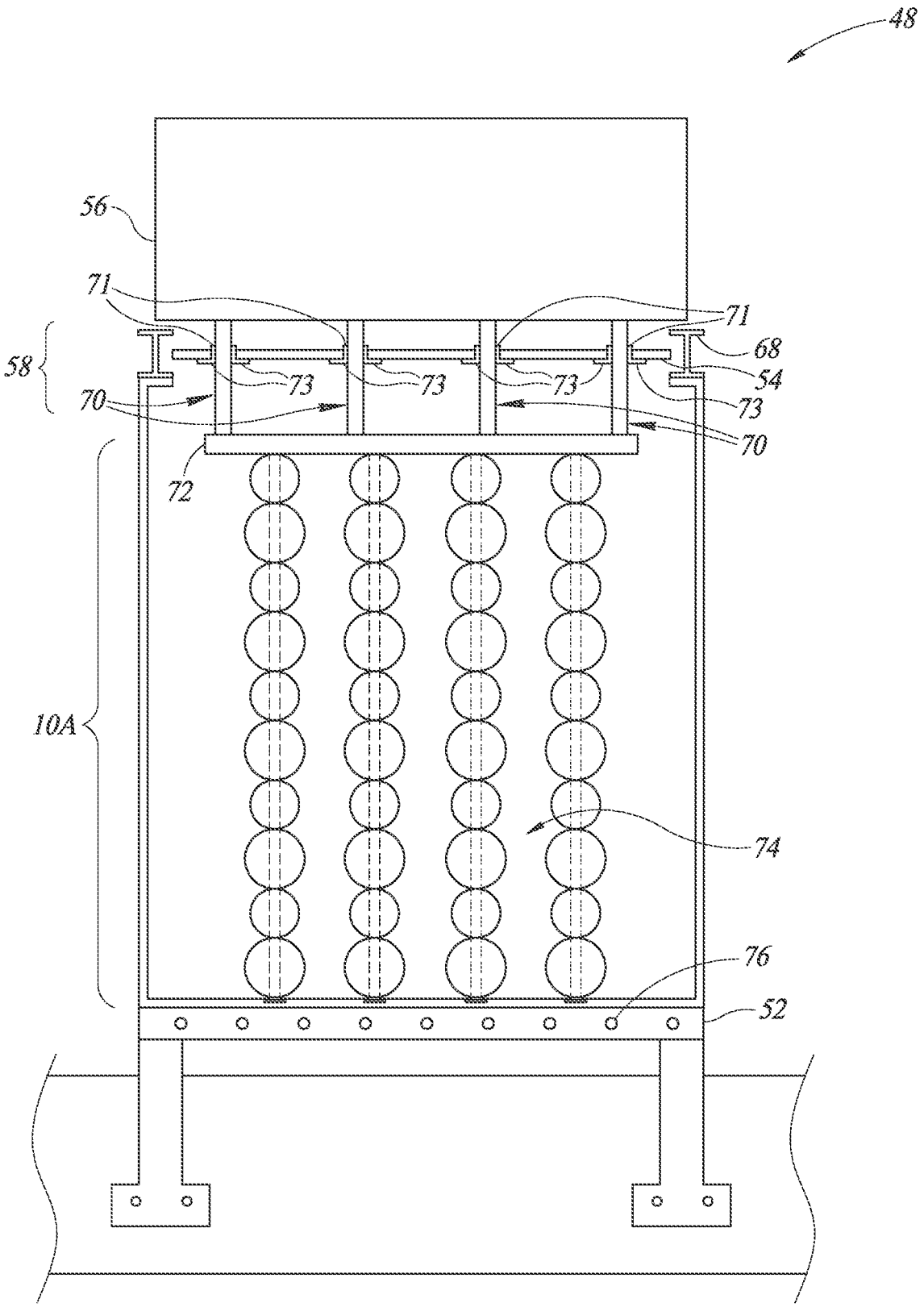
FIG. 8 is a cross-sectional end view of a kiln and of log wall panels under load in the kiln in accordance with an embodiment of the present disclosure.
Figure 9:
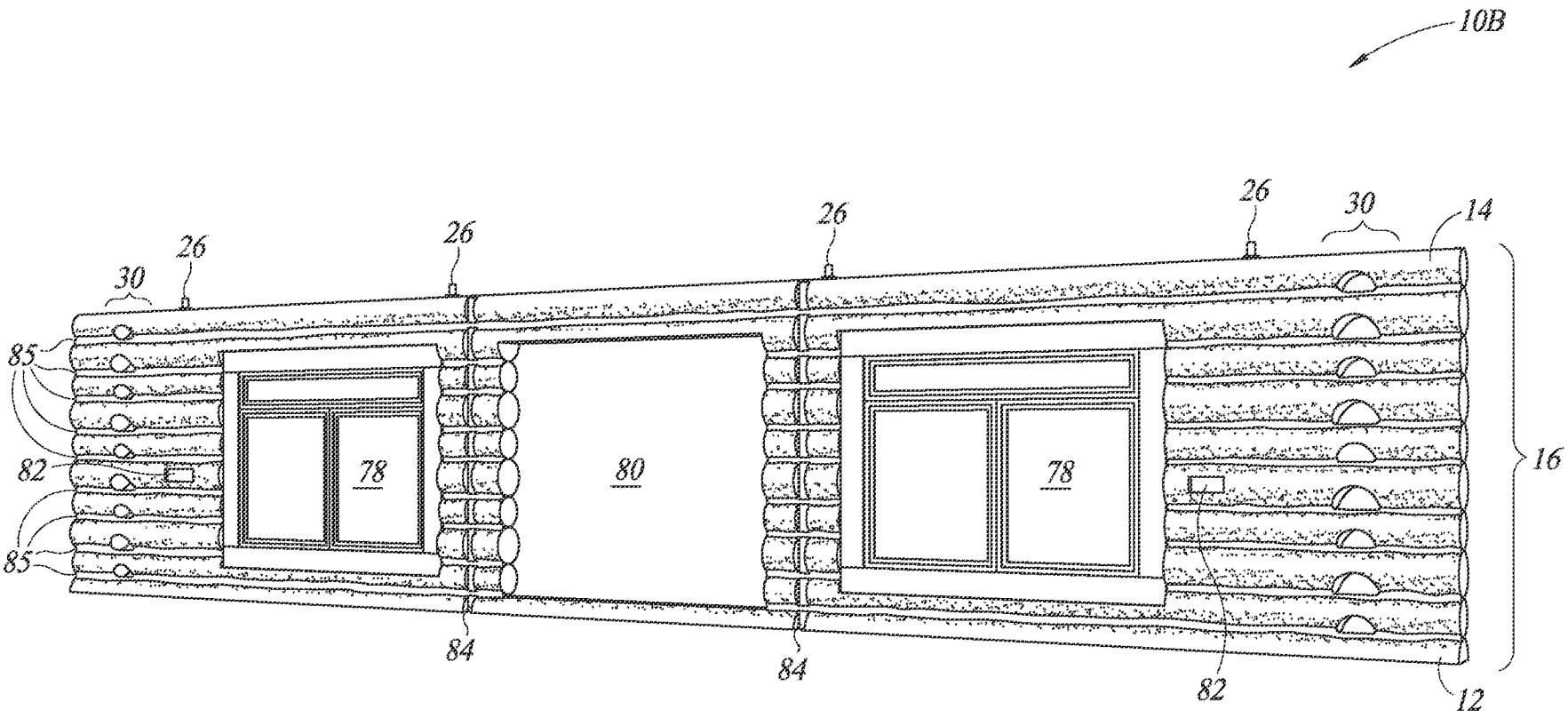
FIG. 9 is a perspective view of a finished log wall panel after being dried under load and fitted with all windows and a door opening cut-outs, windows set and trimmed out, electrical box mortises/rough wiring, and slots to accept interior framed partitions into wall logs in accordance with an embodiment of the present disclosure.

Both the small window openings 44 and the large window openings 46 may be openings cut into the exemplary log wall panel 10A for subsequent installation of windows in the openings (such as depicted in FIG. 9). In some embodiments, the small window openings and the large window openings are made after each of the individual logs 32 are stacked. For example, the partially assembled log wall panel 10 shown in FIG. 4 may first be formed without the small window openings 44 and the large window openings 46, and then the small window openings and the large window openings may be cut out (e.g., with a chainsaw or other suitable cutting instrument). In other embodiments, the window cutouts are made prior to being stacked; for example, the first two logs may be full length when stacked, but the third log may be pre-cut in three pieces, which may be stacked separately. Likewise, the fourth log may be in five pieces stacked separately, and so on until the exemplary log wall panel 10A is completed. In some embodiments, the small window openings 44 and the large window openings 46 are cut out/formed prior to the exemplary log wall panel 10A being dried and/or compressed (e.g., in the drying kiln 48 of FIGS. 6 and 8). It is contemplated that log wall panels of the present disclosure may have no cutouts for windows (e.g., as depicted in FIG. 1), more or fewer cutouts for windows from those shown in FIG. 5, larger or smaller cutouts from those shown in FIG. 5, or may additionally include one or more door cutouts (e.g., the door cutout depicted in FIG. 9).

Figure 6:
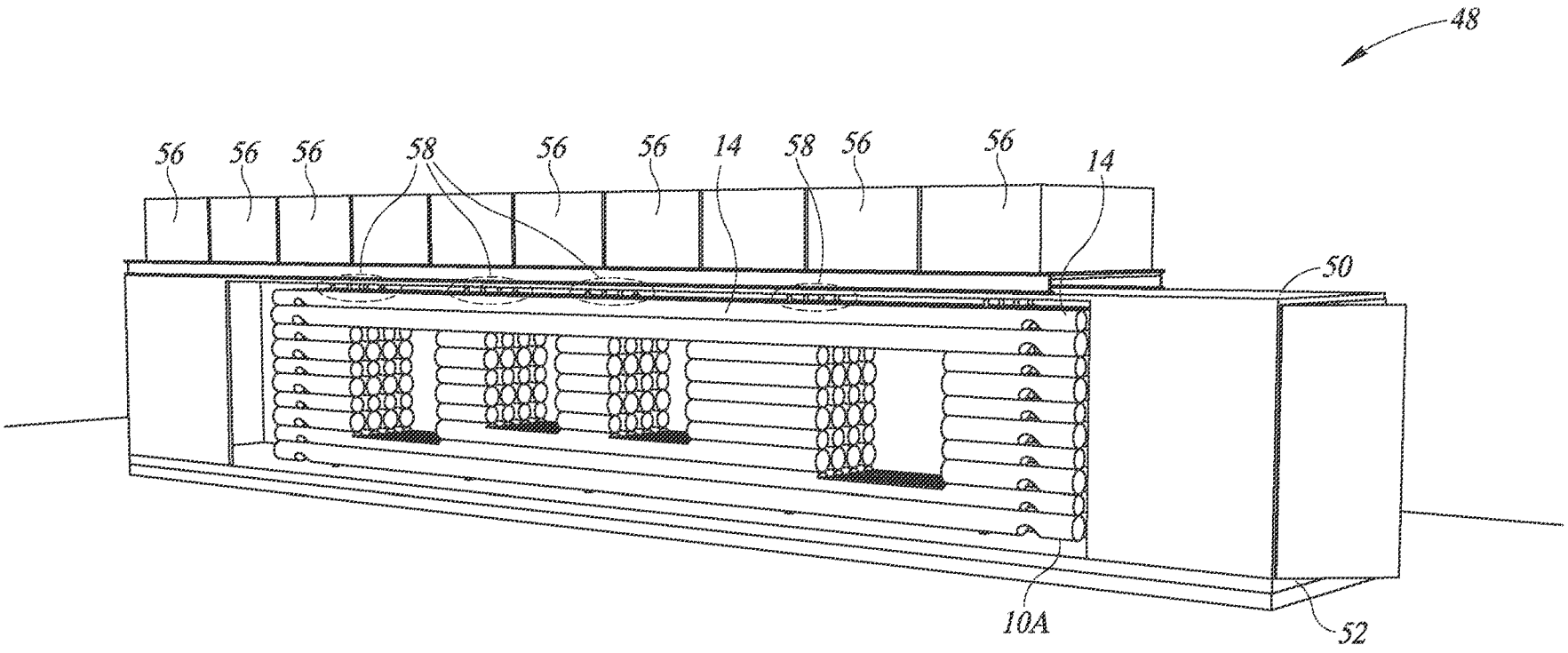
FIG. 6 is a perspective view of log wall panels in a kiln ready for compression and drying process in accordance with an embodiment of the present disclosure.

FIG. 6 depicts a cross-sectional perspective view of the drying kiln 48. As depicted in FIG. 6, the drying kiln 48 may comprise a thermally insulated chamber 50 on a slab 52, with the thermally insulated chamber having a removable ceiling (illustrated as ceiling 54 in FIG. 8), upon the upper surface of which may be placed weights 56. The drying kiln 48 may be used to dry at least one assembled log wall panel, such as the log wall panel 10 or the exemplary log wall panel 10A. Although not illustrated, it is contemplated that there may be one or more openings in the thermally insulated chamber, such as a doorway, through which log wall panels may be brought into or taken out of the thermally insulated chamber.

The drying kiln 48 may be a structure designed to dry and/or heat the one or more log wall panels 10 or 10A for a certain period of time (also referred to as a drying cycle). In some embodiments, probes (not shown) are inserted (e.g., through a test aperture drilled into the logs) that provide measurements of the temperature and/or moisture content of one or more of the logs in the one or more log wall panels during the drying cycle. In this manner, the temperature and rate of drying of the one or more log wall panels in the drying kiln 48 may be monitored and controlled during the drying cycle. For example, in order to approach a goal of the one or more log wall panels being free from fungus, insects, larvae, or other pests, the drying kiln 48 may be heated such that the probes report that the heart of the logs have reach a minimum of 160 degrees Fahrenheit for a duration of 75 minutes. As another example, in order to set the pitch of the wood logs (e.g., crystalize and harden the pitch in the wood to prevent it from "weeping" out of the wood over time), the drying kiln 48 may heat the wood to a temperature between 180 and 200 degrees Fahrenheit for a different duration of time during a second stage of the drying cycle.

The drying kiln 48 may be configured to dry the one or more log wall panels at a temperature and/or duration preselected by an operator of the drying kiln. For example, for a first stage of the drying cycle, the operator may configure the drying kiln 48 to dry the one or more log wall panels at a first temperature for a duration sufficient to dry the logs to a desired moisture content (e.g., two weeks at 130 degrees). The first temperature and/or duration of the first stage may be such that it will not dry the one or more log wall panels too quickly or for too long, thereby reducing the risk of causing the wood logs to crack. During a second stage of the drying cycle, the operator may configure the drying kiln 48 to dry the one or more log wall panels at a second temperature. In some implementations, the second temperature is a temperature that is hotter than the first temperature and/or is of a temperature that causes the wood logs to case harden, kills pests and fungus, and/or change the water absorption or moisture regain of the wood logs to a desired level.

The drying kiln 48 may additionally or alternatively be configured to allow an operator to regulate the humidity within the thermally insulated chamber 50. Most of the moisture of the one or more log wall panels may be purged during a first stage of the drying cycle, and as a result, the drying kiln 48 may develop a high humidity. Therefore, in some of these embodiments, the drying kiln 48 includes a computer system that monitors and/or regulates the moisture content within the thermally insulated chamber 50 in accordance with one or more settings preselected by the operator. For example, the drying kiln 48 may include vents and/or fans whereby moisture emitted from the one or more log wall panels during the drying cycle can be vented/purged from the thermally insulated chamber 50 so as to lower the humidity within the thermally insulated chamber 50 to a level preselected by the operator.

In some cases, venting/purging moisture from the thermally insulated chamber 50 may have a consequence of cooling the drying kiln as well, so in some embodiments the drying kiln has a chamber in the end of the drying kiln that stores a pre-heated fluid, such as a water-ethylene glycol mix, for heating the air in the kiln by passing the air and the pre-heated fluid through a heat exchanger. In some of these embodiments, a tank of the pre-heated fluid is kept in reserve to re-heat the drying kiln quickly after venting the humid air. For example, the pre-heated fluid may be introduced into a coil or other arrangement of thermally conductive tubing within the heat exchanger and, in conjunction with venting/purging the moist air from the thermally insulated chamber, air from external to the thermally insulated chamber may be drawn through the heat exchanger and heated from the radiant heat of the thermally conductive tubing and into the thermally insulated chamber.

In some examples, a "computing device" refers to a programmable electronic device for storing, retrieving, and processing data. In embodiments, a computing device of the kiln may be utilized to process data (e.g., sensor measurements of conditions within the kiln, such as humidity or temperature, during the drying process, duration of stages of the drying process, etc.) for controlling and/or optimizing the drying process (e.g., raising/lowering the kiln temperature, opening/closing vents, etc.). Additionally or alternatively, the kiln may be configured to be manually optimized for the drying process (e.g., temperature and/or vents controlled by manually set timers or switches, etc.). A computing device may include one or more processors configured to communicate with, and are operatively coupled to, a number of peripheral subsystems via a bus subsystem. These peripheral subsystems may include a storage subsystem, comprising a memory subsystem and a file storage subsystem, one or more user interface input devices, one or more user interface output devices, and at least one network interface controller. Such storage subsystem may be used for temporary or long-term storage of information. The bus subsystem may provide a mechanism for enabling the various components and subsystems of computing device to communicate with each other as intended. The network interface subsystem may provide an interface to other computing devices and networks for receiving data from and transmitting data to other systems from the computing device.

The user interface input devices may include a keyboard, pointing devices such as an integrated mouse, trackball, touchpad, graphics tablet, a scanner; a barcode scanner, a touch screen incorporated into the display, audio input devices such as voice recognition systems, microphones, and/or other types of input devices. In general, use of the term "input device" is intended to include all possible types of devices and mechanisms for inputting information to the computing device. The one or more user interface output devices may include a display subsystem, a printer, or non-visual displays such as audio output devices, etc. The display subsystem may include a cathode ray tube, a flat-panel device such as a liquid crystal display, light emitting diode display, or a projection or other display device. In general, use of the term "output device" is intended to include all possible types of devices and mechanisms for outputting information from the computing device. The one or more user interface output devices can be used, for example, to present user interfaces to facilitate user interaction with applications performing processes described and variations therein, when such interaction may be appropriate.

The storage subsystem may provide a computer-readable storage medium for storing the basic programming and data constructs that provide the functionality of at least one embodiment of the present disclosure. The applications (programs, code modules, instructions), when executed by one or more processors may provide the functionality of one or more embodiments of the present disclosure and may be stored in the storage subsystem. The one or more processors can execute these application modules or instructions. The storage subsystem may additionally provide a repository for storing data used in accordance with the present disclosure. The storage subsystem may comprise a memory subsystem and a file/disk storage subsystem.

The memory subsystem may include a number of memories, such as a main random access memory for storage of instructions and data during program execution and/or a read only memory, in which fixed instructions can be stored. The file/disk storage subsystem provides a non-transitory persistent (non-volatile) storage for program and data files and can include a hard disk drive, a floppy disk drive along with associated removable media, a Compact Disk Read Only Memory drive, an optical drive, removable media cartridges, or other like storage media.

The computing device could be of any of a variety of types, including a portable computer device, tablet computer, a workstation, or any other device described below. Additionally, the computing device may include another device that can be connected to the computing device through one or more ports (e.g., USB, a headphone jack, Lightning connector, etc.). Such a device may include a port that accepts a fibre-optic connector. Accordingly, this device may convert optical signals to electrical signals that are transmitted through the port connecting the device to the computing device for processing. Due to the ever-changing nature of computers and networks, this description of the computing device is intended only as a specific example for purposes of illustration. Many other configurations having more or fewer components are possible.

Conversely, the drying kiln 48 may additionally or alternatively be configured to introduce moisture into the thermally insulated chamber 50 so as to raise the humidity within the thermally insulated chamber 50 to the same or another humidity level preselected by the operator. For example, in some embodiments the drying kiln 48 introduces steam, mist, or humid air into the thermally insulated chamber 50 to raise the humidity within the drying kiln to the preselected level. For example, the operator may preselect an upper humidity level of 50% and a lower humidity level of 35%, and the computer system that monitors the moisture content in the drying kiln may automatically vent or add moist air in order to maintain the humidity within the drying kiln within the range of humidity preselected by the operator. In some cases, the preselected humidity range is a normal range for the environment at the preselected destination building site for the one or more log wall panels. In this manner, the moisture content of the one or more log wall panels can be made to match the humidity at the preselected destination building site. In this manner, the one or more log wall panels do not become over-dried at an assembly site, whereupon it begins to absorb moisture at the preselected destination site, or conversely, under-dried at the assembly site and dries out further at the preselected destination site, either of which could cause the one or more log wall panels to change in size and the wood to crack. In this manner, the one or more log wall panels may be produced in a manner so they suffer from less cracking and size change from log homes built in a traditional manner. In some examples, the "assembly site" refers to one or more geographic locations where assembly and processing (see FIGS. 4, 6 and 8) of the log wall panel 10 are performed prior to the log wall panel 10 being shipped to the preselected destination building site. The assembly site may further include climate-controlled conditions (e.g., an indoor facility with temperature and/or humidity controls) that safeguards the log wall panel from atmospheric elements (e.g., such as snow, rain, sun, wind, humidity, heat, cold, etc.) of the preselected destination building site. In some examples, the "preselected destination building site" refers to a geographical location where the log wall panel 10 is to be installed/erected into a building structure. Thus, the assembly site and the preselected destination building site may have different climates and may vary in their patterns of temperature, humidity, atmospheric pressure, wind, and precipitation.

The one or more weights 56 may be weighted objects that, as a result their weight being distributed across the upper end log 14 of the log wall panel 10 cause a directed force 36 (see FIG. 7) to compress the wood fibers of the stack of logs 18, as further described below in conjunction with FIGS. 7 and 8. For example, the one or more weights may be concrete blocks. In this manner, the one or more log wall panels may be pre-compressed by an estimated load during drying in the drying kiln 48 prior to being assembled at the preselected destination building site so that further compression of the one or more log wall panels as a result of such live and dead loads thereon at the preselected destination building site is minimized. This compression may reduce the risk of shrinkage, cracking, and settling of the logs in the one or more log wall panels after assembly at the preselected destination building site. In some implementations, the estimated load is a standard preselected load. However, in other embodiments, the estimated load is customized for the preselected destination building site. For example, the one or more weights 56 may be used to simulate an estimated load that the one or more log wall panels could be subjected to after being installed in a structure at a preselected destination building site. The estimated load may be an aggregation of an estimate of "live" load (e.g., temporary weight, such as caused by snow accumulation on a building structure constructed using the log wall panel 10) and an estimate of "dead" load (e.g., constant weight, such as from building materials of a second story and/or the roof of the structure) at the preselected destination building site.

Benefits of having a pre-compressed log wall panel include less risk of broken windows, less need for special trim or screw jacks to mitigate shrinkage, cracking, and settling that may occur with log walls that are not pre-compressed. Consequently, designs for large windows, tall masonry fireplaces, multiple floor or roof levels, and otherwise complicated architecture are made easier because fewer considerations need to be made for uneven wall settling. In this manner, the building owner may be protected against unforeseen construction costs, and may receive a more structurally sound and attractive building than one built with logs that were not pre-compressed in the manner described in the present disclosure. Moreover, because the log wall panels may be pre-built at the assembly site, the building structure may be constructed much more quickly than a log building built without using the techniques of the present disclosure. In embodiments, the end result of the drying process will be wood that meets the standards for Certified Heat Treated Wood, allowing it to meet United States Department of Agriculture (USDA) standards for interstate and international distribution.

In FIG. 6, the one or more weights 56 are depicted as one or more blocks covering at least the length of a log wall panel 10; in this manner, the force applied to the log wall panel in the upright orientation may be distributed along the length of the upper end log 14. For example, the one or more weights 56 may be ten concrete blocks three feet across and 1½ feet high that, spaced evenly, cumulatively span eight feet of length of the ceiling of the drying kiln 48. However, it is contemplated that alternative methods of applying the directed force 36 to the one or more log wall panels may be used, such as the use of a hydraulic press to apply the (downwardly) directed force. 36.

The quantity of the one or more weights 56 may be adjustably selectable by an operator of the drying kiln (e.g., by removing or adding concrete blocks to the ceiling 54, which bears down on the upper end log 14 and thereby transfers its load to the upper end log, or other manner of adjusting how much pressure each of the one or more weights exerts) according to the number of log wall panels in the drying kiln 48. For example, in a given drying cycle, if the drying kiln 48 is only filled with half of its capacity of log wall panels, the aggregate weight of the one or more weights 56 may be configured to be 50% of the aggregate weight appropriate to compress a full capacity of log wall panels in the drying kiln 48 (e.g., by removing half of the concrete blocks, by using weights that are half the weight of a full weight, etc.). In this manner, the amount of force to apply to the one or more log wall panels can be fine-tuned (e.g., so as to not overload or underload the one or more log wall panels) by adjusting the weight of one or more weights 56 used. Additionally or alternatively, the amount of force directed onto the one or more log wall panels may be adjustably selectable without removing the one or more weights 56 (e.g., by using springs or other mechanisms to offset a portion of the force of the one or more weights). In some embodiments, one or more force-directing assemblies 58 is used to direct the force. Further details on the force-directing assemblies are provided below in connection with FIG. 8.

The thermally insulated chamber 50 depicted in FIG. 6 is a cuboid having six sides (including the slab 52 and the ceiling 54) and sufficient height and width to hold at least four log wall panels of the present disclosure, in an upright orientation. However, it is contemplated that the thermally insulated chamber 50 may be constructed to contain more or fewer log wall panels than the quantity of log wall panels illustrated in FIG. 6. The walls of the thermally insulated chamber 50 may be constructed of thermally insulating materials (materials with low thermal conductivity), such as bricks or concrete, that reduce the transfer of heat from the interior of the thermally insulated chamber 50 to the outside of the thermally insulated chamber 50.

The slab 52 may operate as the floor of the drying kiln 48. In some embodiments, the slab 52 is concrete. In other implementations, the slab 52 is made of brick or other heat-resistant material suitable for flooring of the drying kiln 48.

Figure 7:
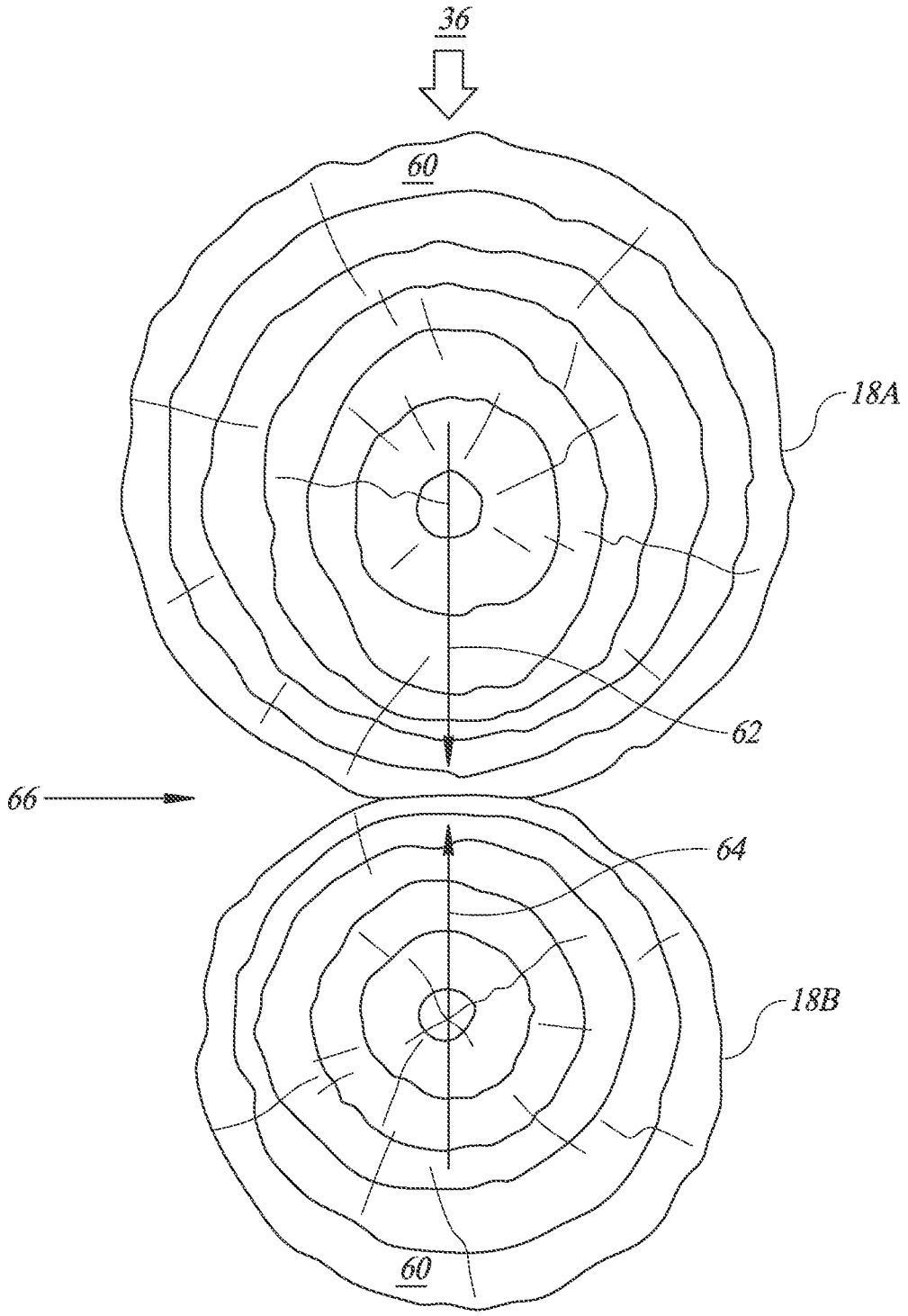
FIG. 7 is a cross-sectional end view of logs illustrating the crushing of wood fibers in a log wall stack in accordance with an embodiment of the present disclosure.

FIG. 7 depicts a cross sectional end view of a first log 18A and a second log 18B positioned therefore in one stack of logs, such as the stack of logs 18, to illustrate compression of wood fibers 60 due to the (downwardly) directed force 36, such as resulting from pressure from the one or more weights 56. For example, when the logs are in a planar orientation and the directed force 36 is applied to an upper portion of the first log 18A, the wood fibers 60 of the first log may be compressed as a result of opposing forces in the downward direction 62 and upward direction 64 resulting from the directed force 36 applied to the first log 18A. Note that, in some instances where a lateral wall log interface has a gap between the top of the second log 18B and the bottom of the first log 18A, the gap may be shimmed. In such instances, the compression of the wood fibers in the wall logs may happen over and under the shim.

The directed force 36 may be a force applied to the stack of logs 18 to cause wood fibers of the stack of logs 18 to compress in a manner further detailed in FIG. 7. In some embodiments, the directed force 36 is produced by applying weights to the upper end log 14 while the stack of logs 18 is in an upright position. In this manner, the pull of gravity on the weights produces the downwardly directed force 36. In other implementations, however, the force is produced mechanically, such as through the use of a hydraulic press. The directed force 36 may be applied to the stack of logs 18 while the stack of logs 18 are drying, such as while the log wall panel 10 is being dried in a kiln, such as the drying kiln 48 shown in FIG. 6. The directed force 36 may be transferred from the first log 18A to the second log 18B at lateral connection points 66 between the logs (along the length of each adjacent log).

FIG. 8 depicts an end view of the drying kiln 48 of an embodiment of the present disclosure. As depicted in FIG. 8, the drying kiln 48 may comprise the thermally insulated chamber 50 on the slab 52, with a ceiling 54, to which the weight of the one or more weights 56 is applied. In the embodiment depicted in FIG. 8, the weights 56 are supported by one or more beams 68 when not in use during a drying process. In some embodiments, the drying kiln 48 includes one or more force-directing assemblies 58. Two or more log wall panels may be separated by a gap 74 to provide airflow to allow the drying kiln 48 to dry the one or more log wall panels efficiently. Heat may be transferred into the drying kiln 48, in some embodiments, by radiant tubing 76 embedded in the slab 52.

The ceiling 54 may enclose the upper end of the drying kiln 48. In some embodiments, the ceiling 54 is removable. In embodiments, when the one or more weights 56 are placed onto the plurality of connector members 70 that extend through the ceiling, the force of gravity on the one or more weights applies force to upper end logs 14 of the one or more log wall panels.

Force-directing assemblies 58 may comprise at least a plurality of connector members 70 extending through the ceiling 54 and, at an upper end of the plurality of connector members 70, upon which the one or more weights 56 rest. In some implementations, the ceiling is fixed, whereas in other implementations, the ceiling is vertically moveable. Attached to a lower end of the plurality of connector members 70 may be one or more cross members 72.

The one or more beams 68 may be steel I-beams supporting the one or more weights 56, such as concrete blocks, when the drying kiln 48 does not contain any log wall panels.

The plurality of connector members 70 may be elongated objects, extending through a plurality of apertures 71 in the ceiling 54, suitable for transferring force (e.g., the directed force 36 due to gravitational pull on the one or more weights 56). For example, the plurality of connector members 70 may be 2⅞ inch diameter ¼ inch wall metal pipes attached at the lower end to the at least one cross members 72. However, it is contemplated that the plurality of connector members may alternatively be rods, bars, angle irons, I-beams, or other structural member suitable for conveying the directed force 36. In some embodiments, the ceiling 54 includes plurality of sealing members 73, such as rubber seals, through which the plurality of connector members 70 extend. In this manner, the plurality of sealing members 73 can mitigate the occurrence of heat from the thermally insulated chamber 50 escaping through the plurality of apertures 71 in the ceiling 54.

At least one cross members 72 may span across the one or more log wall panels. In this manner, the directed force 36 due to gravity may be transferred from the one or more weights 56 through the plurality of connector members 70 to the at least one cross members 72 and to the one or more log wall panels, such that the wood fibers of the one or more log wall panels are compressed in a manner illustrated in FIG. 7. For example, as illustrated in FIG. 6, there may be a plurality (e.g., three, ten, twenty-eight, etc.) of cross members that distribute the directed force along the length of the upper log of the one or more log wall panels in the thermally insulated chamber 50.

The gap 74 may be a space separating two of the one or more log wall panels 10A from each other in order to provide airflow for improving the ability of moisture to escape from the individual logs 32 of the one or more log wall panels during the drying process. In some embodiments, a minimum gap is between five and eight inches.

The radiant tubing 76 may be metal pipes or other tubing embedded in the slab 52 and connected to a heat source of the drying kiln 48 so as to radiate heat into the interior of the thermally insulated chamber 50. For example, the radiant tubing 76 may provide a conduit for steam, from a heat source such as a boiler, to transfer heat into the thermally insulated chamber 50 to dry the one or more log wall panels.

FIG. 9 depicts a variation of the log wall panel 10, indicated as a finished log wall panel 10B, shown after it has been dried and/or compressed in the drying kiln 48 with further finishing procedures applied after completion of the drying process. For example, because the one or more log wall panels may have shrunk during the drying process (e.g., due to the compression of wood fibers due to the directed force 36 and/or loss of moisture due to the drying), the upper securement members 26 of each of the plurality of connector assemblies 20 may be secured to the elongated connector members 22 or, if already secured to the elongated connector members 22, may be tightened down so as to secure the logs in the finished log wall panel 10B in place (e.g., keep them from moving vertically). In some embodiments, the plurality of upper securement members 26 are sized larger than the plurality of apertures 34 of the upper end log 14 so as to be unable to pass through those apertures.

Furthermore, the finished log wall panel 10B may include one or more windows 78, at least one door opening 80, one or more electrical fixture cutouts 82, and/or one or more electrical wiring cutouts 84. Because the novel techniques and articles of manufacture of the present disclosure allow entire log wall panels to be fabricated at the assembly site and shipped and assembled into a building structure at the preselected destination building site in panel form, rather than assembling the building structure at the preselected destination building site one log at a time, the log wall panels of the present disclosure have the advantage of also being able to include finishing procedures such as those performed to the finished log wall panel 10B shown and described concerning FIG. 9, that would otherwise have to be done at the preselected destination building site.

Other finishing procedures that may be performed to the log wall panel 10 or the finished log wall panel 10B at the assembly site prior to shipment to the preselected destination building site include lateral grooves and/or chinking 85 (e.g., applying mortar or other infill material) between the individual logs 32 of the log wall panels and/or staining (as illustrated by shading in FIG. 9) the logs of the log wall panels to a predetermined color (e.g., based on client selection). Performing these processes at the assembly site may have the benefit of reducing time and expense of constructing the building structure, such as by protecting the logs from outdoor atmospheric elements and thereby eliminating the need for acid washing the logs at the preselected destination building site prior to staining, the need to wait for suitable weather conditions at the preselected destination building site prior to chinking and/or staining, and the need to stop other work at the preselected destination building site while the delicate work of log cleaning and staining is completed.

The one or more windows 78 may be finished windows (e.g., with glass, sills, sashes, panes, lintels, and/or millwork) installed and trimmed out in the small window openings 44 and/or large window openings 46 of the exemplary log wall panel 10A after the one or more log wall panels have completed the drying process in the drying kiln 48.

At least one door opening 80 may be at least a partial cutout for a doorway or for later installation of a door at the preselected destination building site. In some embodiments, and as illustrated in FIG. 9, at least one door opening includes the lower end log 12 (sill log) that is intact (e.g., not completely cut out for the door opening). In this manner, the intact lower end log provides structural stability for the finished log wall panel 10B during handling/shipment and delivery to the preselected destination building site, whereupon the finished log wall panel 10B may be installed and, once installed, a portion of the lower end log may be cut out to finish the door opening at the preselected destination building site. Alternatively, it is contemplated that at least one door opening 80 may be cut through the lower end log 12, and bracing or other securement structure may be attached to provide stability for the log wall panel 10B during shipment.

The one or more electrical fixture cutouts 82 may be a cutouts to allow the installation of electrical components, such as electrical outlets, light switches, and/or cable, telephone, or network connections. In some implementations of the finished log wall panel 10B, the electrical components themselves are installed at the assembly site prior to shipment of the finished log wall panel 10B to the preselected destination building site.

The one or more electrical wiring cutouts 84 may be cutouts for holding electrical, network, and/or telephone wiring. At the preselected destination building site, the wiring may be routed through conduit through the one or more electrical wiring cutouts 84 and/or covered or camouflaged with a cord cover.

Figure 10:
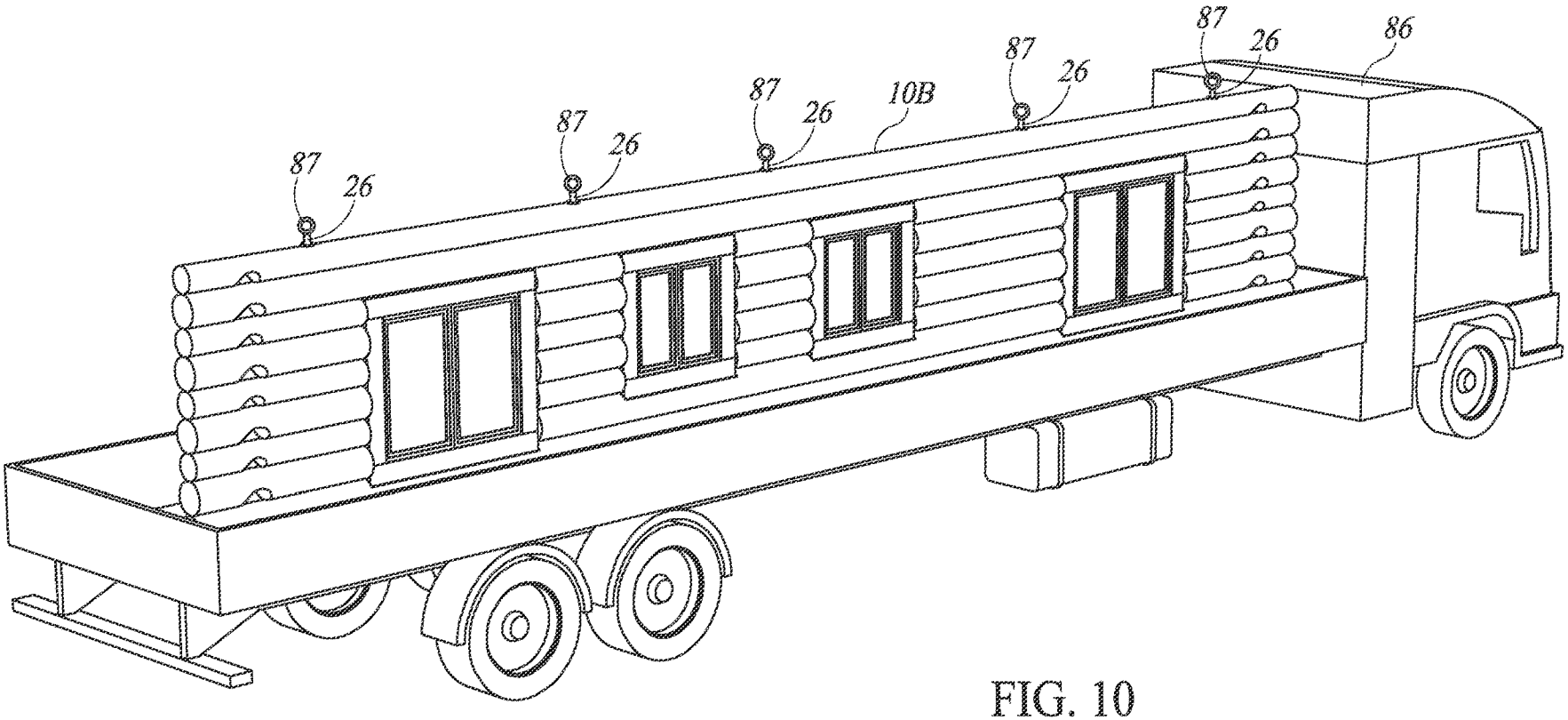
FIG. 10 is a perspective view of a finished log wall panel securely loaded onto a truck for shipment to a construction site in accordance with an embodiment of the present disclosure.

FIG. 10 depicts a perspective view of another variation of the finished log wall panel 10B (this one being an example of a finished version of the log wall panel 10 that does not have the at least one door opening 80 shown in FIG. 9) loaded onto a transport vehicle 86 for shipment to a preselected destination building site. FIG. 10 illustrates that the log wall panel 10B is assembled at the assembly site from where it is deliverable in the form of a log wall panel to a preselected destination building site for assembly into a building structure. It should be noted that although FIG. 10 depicts the finished log wall panel 10B on the transport vehicle 86, the log wall panel 10 may additionally or alternatively (either after being dried in the drying kiln 48 or without being dried in the drying kiln) be shipped to the preselected destination building site to be finished or installed on-site in panel form.

The transport vehicle 86 is illustrated in FIG. 10 as being a motor vehicle designed to transport cargo, such as a flatbed truck. However, it is contemplated that other types of transport vehicles, additionally or alternatively, may be used to ship the log wall panels of the present disclosure. For example, the log wall panels, additionally or alternatively, may be transported in shipping containers, and or by a railroad car or cargo ship. It is noted that, although the finished log wall panel 10B is shown to be unwrapped in the transport vehicle, in many cases the finished log wall panel 10B may be wrapped/encased with one or more types of protective material and secured on the transport vehicle in a manner suitable to protect the log wall panel from damage during shipment.

In some embodiments, eye bolts 87 are attached (e.g., removably threaded onto, welded, etc.) to upper portions of the upper securement members. In this manner, the finished log wall panel 10B may be conveniently loaded onto and unloaded from the transport vehicle 86 using a crane, a hoist, block and tackle, or other similar device by hooking a hoist rope, chain, or cable through the eyes of the eye bolts 87 and raising/lowering the finished log wall panel.

Figure 11:
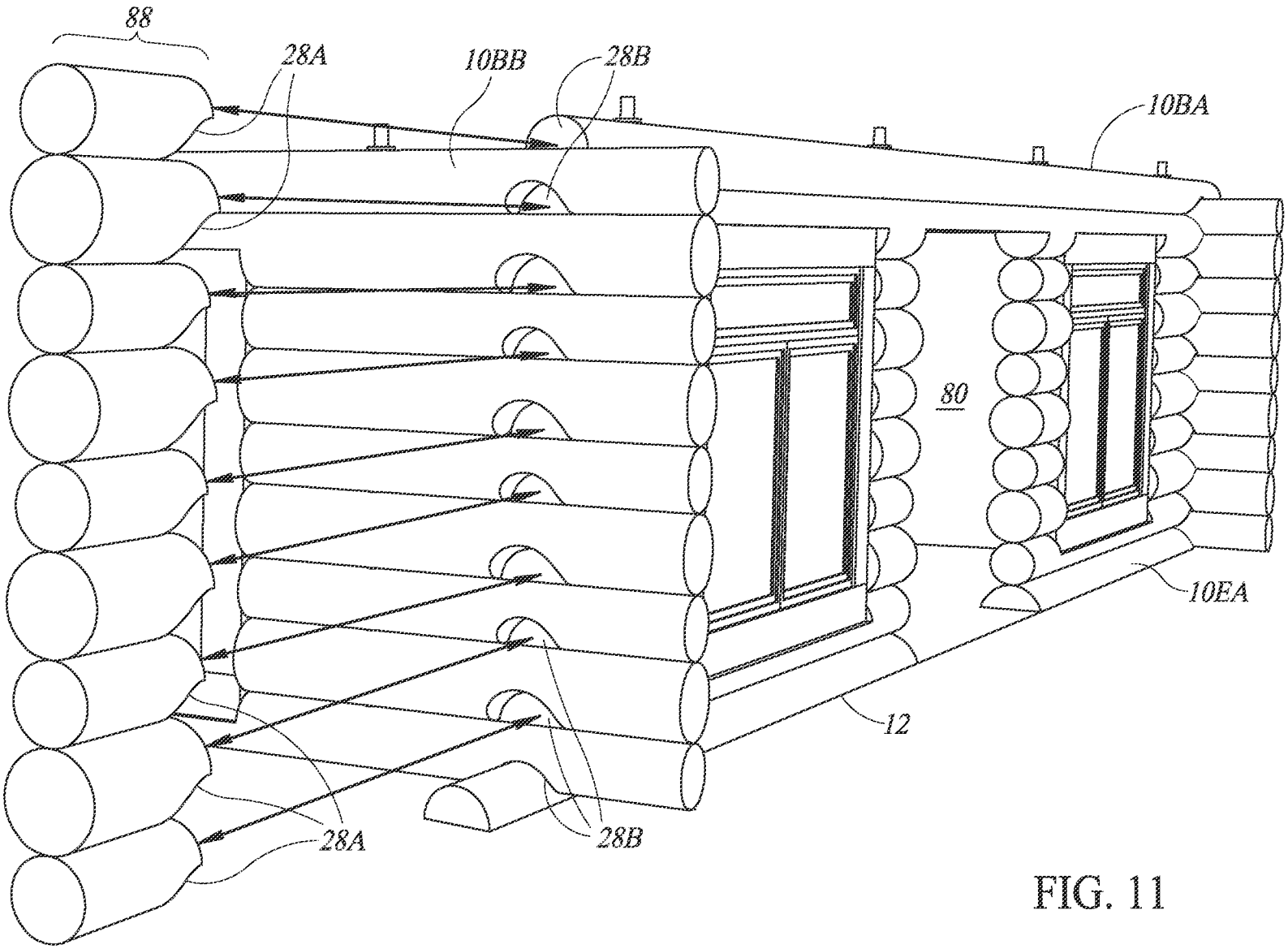
FIG. 11 is a perspective view of a finished log wall panel with temporary separated tail portions in accordance with an embodiment of the present disclosure.

FIG. 11 depicts perspective view of assembling the finished log wall panel 10B (referred to below as a first log wall panel 10BA) with another of the finished log wall panels 10B (referred to below as a second log wall panel 10BB together at a preselected destination building site. As shown in FIG. 11, the first log wall panel 10BA is presently installed, has had a portion of the lower end log 12 cut out to fully form the at least one door opening 80 (in contrast to the lower end log 12 illustrated in FIG. 9). That is, the lower end log 12 may have been left uncut during handling and shipment to the preselected destination building site for structural stability, but now having been installed at the preselected destination building site may be removed. The first log wall panel 10BA, as illustrated in FIG. 11, further may have tail/end portions 88 of the logs 32 removed so that the second log wall panel 10BB can be joined at the notches 28 to the first log wall panel 10BA. This may be accomplished by moving the second log wall panel 10BB toward the left end of the stationary first log wall panel 10A until the ends of the logs of the first log wall panel 10BA extend through the notches 30 for the second log wall panel 10BB.

The first log wall panel 10BA and the second log wall panel 10BB may each be any of the log wall panels described above or others. In some embodiments, log wall panels being assembled into a building structure at the preselected destination building site are grouped into two sets: a first set of log wall panels that, when assembled into the building structure, will run parallel to each other, and a second set of log wall panels that, when assembled into the building structure, will run perpendicular (or other transverse angle) to the first set. In some embodiments, the first set of log wall panels is erected first and attached to a foundation of the building. Next, at least some of the tail/end portions of the first set of log wall panels are temporarily removed (e.g., by sawing them off) to allow the second set of log wall panels to be moved into position with the ends of the logs of the first set extending through the notches of the second set, and then attached to the first set. Lastly, the temporarily removed tail/end portions may be reattached to the first set of log wall panels (e.g., by lag screws or other attachment members that may be specified by structural engineer; additionally or alternatively, epoxy may be used in the reattachment of the tail/end portions to the first set of log wall panels).

In FIG. 11, the first log wall panel 10BA may belong to the first set and the second log wall panel 10BB may belong to the second set. Thus, as shown in FIG. 9, the first log wall panel 10BA has been installed/erected and the tail/end portions 88 have been removed.

In some examples, a "tail" portion of the individual log 32 refers to a portion of the individual log that continues outward longitudinally outward from the notch location at the end (e.g., left-end or right-end). For example, the tail/end portion of the individual log may extend 18 inches from the notch location. In some embodiments, the end portions of the log are squared dovetails and extend minimally or not at all from the corner joint when two log wall panels are joined.

The tail/end portions 88 may be removed by vertical cut through the notches (e.g., at the center) of the first log wall panel 10BA. In some implementations, the vertical cut roughly bisects the notches at their peak. The vertical cut may be performed by a saw (e.g., handsaw, chainsaw, etc.) or other suitable wood cutting instrument. The vertical cut severing the tail/end portions 88 may result in the notches 28B of the first log wall panel 10BA now opening longitudinally outward; likewise, the portion of the notches 28A remaining on the tail/end portions 88 may open longitudinally outward. The longitudinally outward opening at the notch portion of the first log wall panel 10BA may thereby allow the second wall panel 10BB to be installed transverse to the planar orientation of the first log wall panel 10BA, intersecting at the notches 28B, thereby forming a corner joint.

Once the second log wall panel 10BB is in place, the second log wall panel may be secured to the first log wall panel 10BA for additional structural stability. For example, ⅝"Ø lag bolts may be set into each intersecting corner notch to attach the individual logs of the two intersecting log wall panels. Next, the tail/end portions 88 may be reattached, such as through the use of lag screws/bolts or other attachment component. In order for the attached tail/end portions to have the appearance of being continuous with the first log wall panel 10BA, each of the tail/end portions 88 may be matched back to the individual log of the first log wall panel 10BA from which it was removed. Furthermore, each of the tail/end portions 88 may be reattached one by one in sequence (e.g., from the bottom up) in order to conceal the lag screws/bolts or other attachment component used. It is noted that, in some embodiments, a tail/end portion of the lower end log 12 is retained (e.g., not detached). Retaining the tail/end portion of the lower end log 12 may have the benefit of providing a stable and strong support for the tail/end portions 88 during and after reattachment. In some implementations, the tail/end portions of at least some of the preassembled log wall panels described in the present disclosure are removed at the assembly site and the log wall panels and their respective tail/end portions may be shipped independently from each other.

Figure 12:
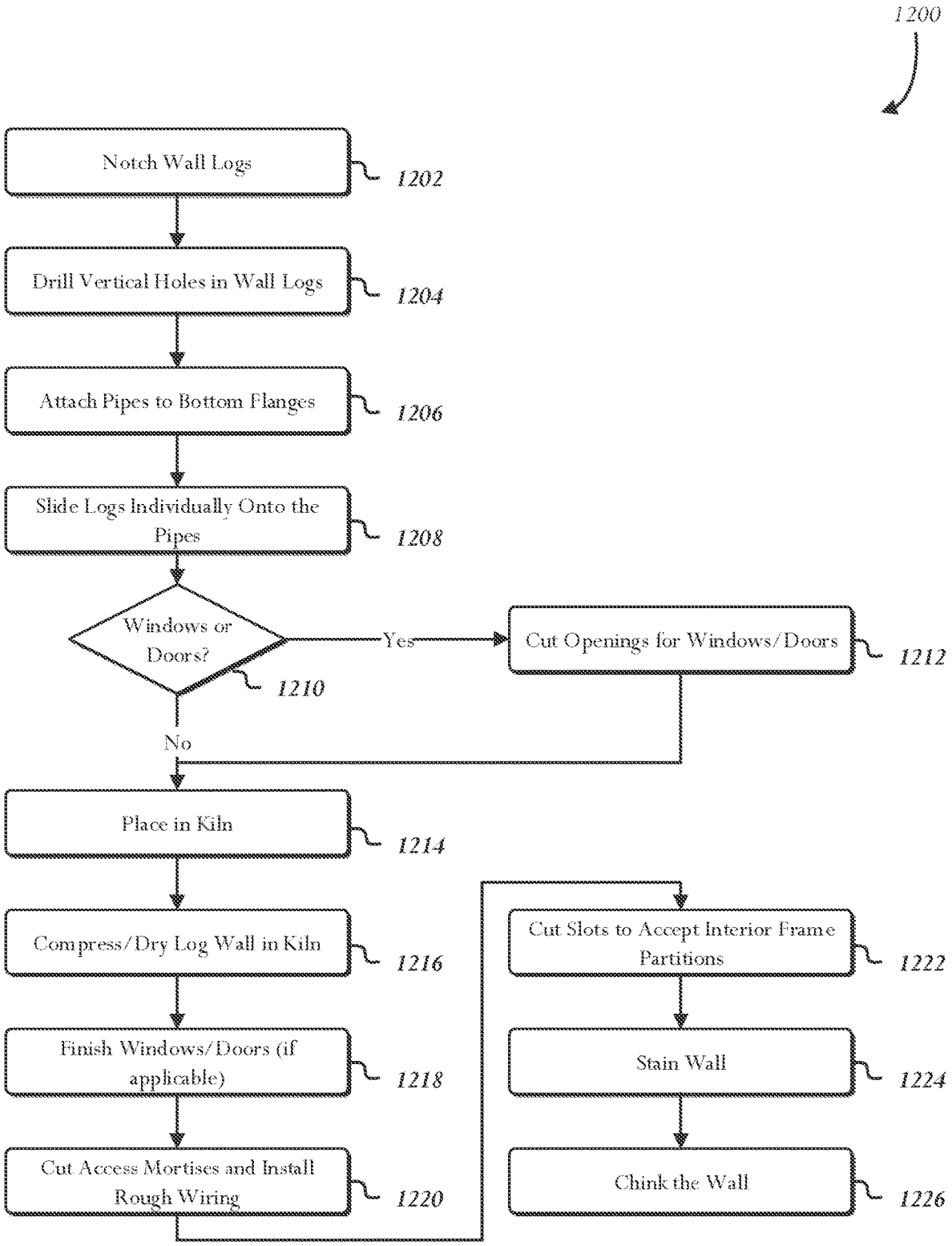
FIG. 12 is a flowchart that illustrates an example of a process of assembling a log wall panel in accordance with an embodiment of the present disclosure.

FIG. 12 is a flowchart illustrating an example of a process 1200 for assembling a log wall panel in accordance with various embodiments of the present disclosure. For example, the process 1200 may be applicable to assembly of the partially assembled log wall panel 10B depicted in FIG. 4. The process 1200 includes a series of operations wherein holes and notches are made in the individual logs, lower end flanges are attached to the lower end of a plurality of pipes, and then the plurality of pipes are extended through the holes to hold in a stack formation.

In some embodiments, operators using a computing device (and software) generate set of drawings for each log wall of a building structure to be constructed at a preselected destination building site. The set of drawings may include dimensions of each log wall, locations of notches in individual logs of each log wall, locations for a plurality of holes (apertures) in the individual logs for a plurality of pipes (elongated connector members) to be inserted, and other such specifications. At the assembly site, the operators may use the drawings as a reference to select and shape the individual logs to fit the drawings as described below.

For example, in 1202, each individual log may be notched (e.g., see the left-end notch 28 and right-end notch 30) in a manner that will fit over (or, in some implementations, under) another log that intersects transverse to the individual log to form a corner joint.

In 1204, the plurality of holes may be drilled in the individual logs in accordance with the drawings so that they can be assembled into the log wall panel 10. The plurality of holes may be drilled in each individual log in a manner such that when the individual logs are arranged in a stack of logs, the plurality of holes are aligned. In this way, the stack of logs 18 ends up with a plurality of aligned holes through which the plurality of pipes can be extended to hold the stack in a planar arrangement.

In 1206, a plurality of lower end flanges (e.g., see the lower securement members 24) may be attached to the plurality of pipes. In this manner, when the plurality of pipes are extended through the plurality of apertures of the individual logs, and thereby the plurality of aligned apertures of the stack of logs, the plurality of lower end flanges keep the lower end log 12 from slipping off of the plurality of pipes. It is noted, in some implementations, the plurality of pipes have lower end portions that exceed the diameter of the plurality of holes. Such implementations may dispense with the need for lower end flanges, and consequently this operation may be omitted.

In 1208, each of the individual logs 32 may be slid onto the plurality of pipes, such as in the matter illustrated in FIG. 4. For example, the plurality of lower end flanges may be temporarily (removably) affixed to a lower end beam, the plurality of pipes may be threaded onto the plurality of lower end flanges in a vertical arrangement, and each of the individual logs may be slid onto the plurality of pipes (see FIG. 4). The lower end beam may be made of any of a variety of suitable materials; for example, the lower end beam may be a wood or steel beam.

It must be noted that alternatively, the individual logs may be aligned and the plurality of pipes may be inserted in the plurality of holes. In either case, however, the end result is the stack of logs 18 arranged in a planar formation that is secured by the plurality of poles and the lower securement members 24. In some embodiments, a plurality of upper end flanges (e.g., the upper securement members 26) is not attached to the upper ends of the plurality of pipes until after completion of drying the stack of logs in a drying kiln (see process 1300 of FIG. 13). However, in other implementations, the upper end log 14 of the stack of logs 18 is secured as well by attaching the plurality of upper end flanges (tightly or loosely, as preferred) to an upper end of the pipe (and tightened further after the drying process is complete). The result at this step may be the log wall panel 10.

In 1210, a determination may be made whether windows and/or doors are to be installed in the log wall panel 10. If so, in 1212, openings for windows and/or at least partial openings may be cut into the log wall panel 10 so as to produce a log wall panel such as the log wall panel 10B. Once the openings and/or at least partial openings are cut out, or in a case where the log wall panel 10 is determined not to need such openings, in 1214, the log wall panel may be placed in a drying kiln, such as illustrated in FIGS. 6 and 8. Thereupon, in 1216, the log wall panel may be compressed and dried in a manner described in operations 1304-20 of the process 1300 of FIG. 13.

After the log wall panel 10 has completed the compression and drying process, additional finishing procedures, such as one or more of the operations of 1218-26, may be performed. For example, if openings were cut for windows and doors in 1212, the windows and doors may be finished in 1218, such as by sanding the openings (e.g., the small window openings 44, the large window openings 46, the at least one door opening 80, etc.) and installing, and trimming out the one or more windows 78.

As another example, in 1220, access mortises, the one or more electrical fixture cutouts 82, the one or more electrical wiring cutouts 84, and rough wiring may be installed in the finished log wall panel 10B. Likewise, in 1222, slots may be cut into the log wall for interconnecting with interior frames/partitions. In 1224, the logs may be stained (like as illustrated by the shading in FIG. 9). Additionally or alternatively, chinking may be performed between the individual logs of the log wall panel. The result of performing one or more of these finishing procedures may be a finished log wall panel, such as the finished log wall panel 10B of FIG. 9.

It is noted that one or more of the operations performed in 1202-26 may be performed in various orders and combinations, including in parallel. For example, the operations of 1202-06 may be performed in any order or in parallel; for example, a first person could be drilling a hole in a first log for the log wall panel while a second person is cutting notches in a second log for the log wall panel, and a third person could be attaching the lower end flanges to the pipes. Likewise, in various implementations, the finishing operations 1218-26 may be performed in a different order, and may omit some or all of the finishing operations 1218-26 and/or include additional finishing operations not shown or described in FIG. 9.

Figure 13:
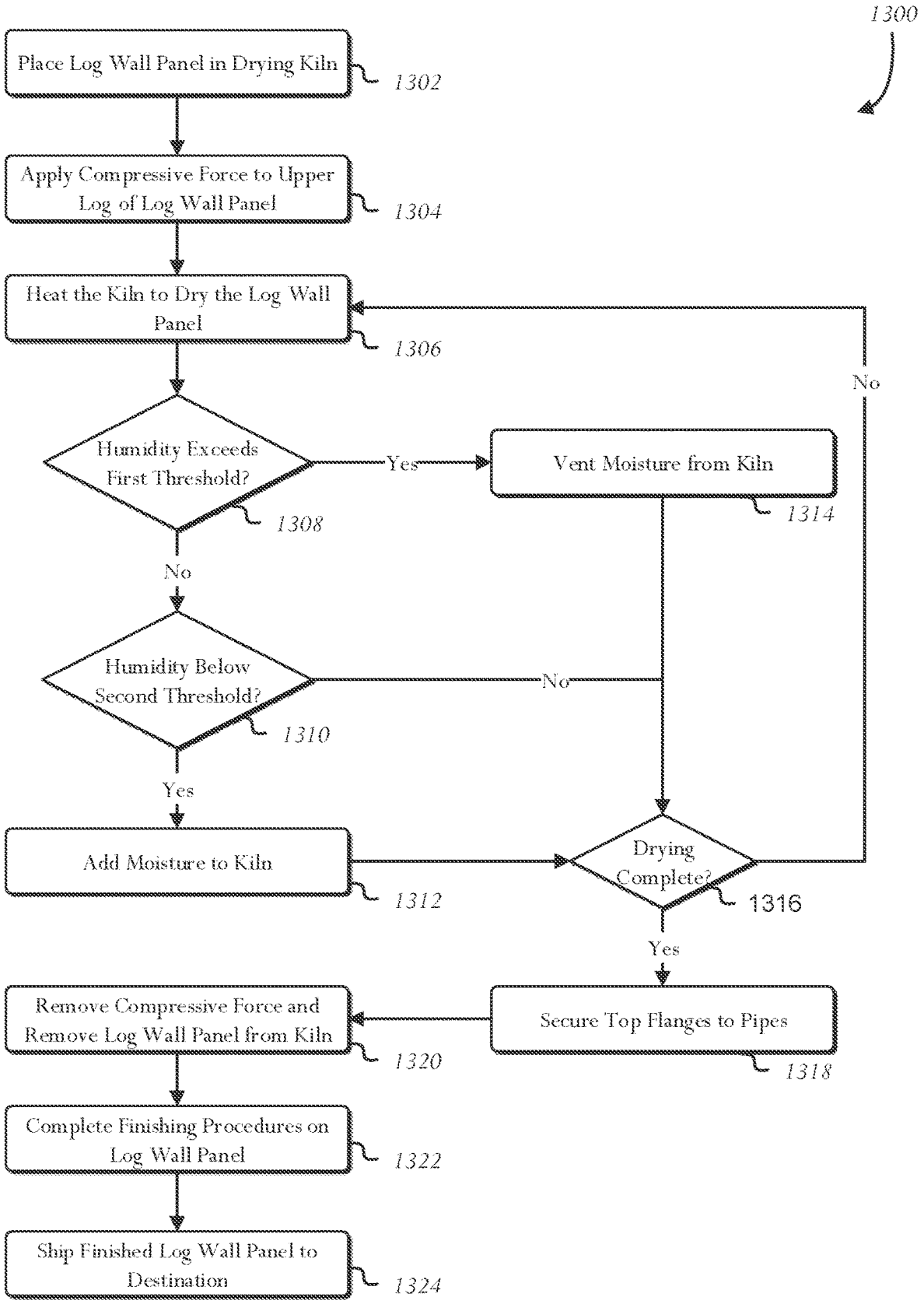
FIG. 13 is a flowchart that illustrates an example of a kiln drying/compression process (shown on FIG. 12 as 1216) of processing an assembled log wall panel in accordance with an embodiment of the present disclosure.

FIG. 13 is a flowchart illustrating an example of a process 1300 for drying and pre-compressing logs in accordance with various embodiments of the present disclosure. For example, the process 1300 may be applicable to drying one or more logs, such as the log wall panel 10 in the drying kiln 48 depicted in FIGS. 6 and 8. The process 1300 may be performed by an entity, such as an operator of the drying kiln 48 individually or in conjunction with a computing system, using the drying kiln 48 and the at least one log wall panel 10A. The process 1300 includes a series of operations wherein a log wall panel is subjected to the directed force 36, heated to cause the logs to dry, humidity is maintained within a predetermined range (venting and/or adding moisture as needed), an upper end flange is firmly secured before the directed force 36 is removed, any finishing procedures are performed, and the finish log wood panel is shipped to a preselected destination building site.

In 1302, the process 1300 begins with placing a log wall panel, such as the log wall panel 10 in the drying kiln 48. In 1304, a weight sufficient to produce the directed force 36 are applied to the upper end log 14 of the stack of logs 18 to cause the wood fibers of the individual logs to compress in the manner illustrated in FIG. 7 during the drying process. As noted above, the amount of compressive force to apply to the log wall panel may be preselected to accord with an estimated amount of load the log wall panel may experience while installed in a building structure at the preselected destination building site. The amount of load may be estimated by estimating the weight (e.g., contributed by the roof structure itself, roofing material, ceilings, and/or other stories of the building structure) that may be applied to the log wall panel when installed. Likewise, the estimated weight may also take into consideration the potential weight of snow on the roof. In some cases, the estimated weight may use seasonal averages, or, in other cases, may use seasonal highs in estimating the potential weight of snow at the geographic location of the preselected destination building site. Because the drying process may take only a few days or weeks, whereas the load experienced by the log wall panel when installed in the building structure may go on for years, in some implementations, the estimated weight is further adjusted by a weight factor (e.g., increased by 10%) in order to apply additional compressive force to cause the wood fibers of the logs to be compressed to an amount comparable to what an un-precompressed log wall (a log wall that is not pre-compressed) would experience while installed in the building structure for a number of years (e.g., four years or more).

An operator may determine a plan for how high to raise the temperature within the kiln and for how much time for each stage of the drying process in order to control wood checking of the logs potentially caused by drying the logs at too high of a temperature or too quickly or for too long. The temperature and duration of drying at that temperature of a given stage of the drying process may vary based on the type of wood of the log, the initial moisture content of the log, and other factors. The drying process may include multiple stages whereupon the temperature and duration drying at that temperature are adjusted specifically for that stage. As described above, a first stage may have a temperature and duration sufficient to dry the stack of logs 18 to a certain moisture level and a second stage may have a temperature and duration sufficient to case harden the outer layer of the wood log and/or exterminate any insects or fungus potentially infesting the wood. Consequently, in 1306, a heat source, such as a boiler, may generate and transfer heat into the thermally insulated chamber 50 (such as via the radiant tubing 76) to raise the thermally insulated chamber 50 to a temperature sufficient to cause the stack of logs 18 to emit moisture in accordance with the plan for the drying process.

As noted above, in various embodiments, the moisture content of the log wall panel can also be customized to the geographic location of the preselected destination building site. For example, wood in a building structure in a desert climate may be expected to dry to a moisture content of approximately 7% moisture. In contrast, wood in a building structure in a tropical climate may be expected to dry to a moisture content in the approximate range of 24% to 25%. Likewise, wood in a temperate climate may be expected to reach a moisture content in the approximate range of 10%-15%. By pre-drying the stack of logs 18 to a moisture content that corresponds to the geographic location of the preselected destination building site under the controlled conditions of the drying kiln as described in the present disclosure, additional shrinking of the logs (e.g., from the wood drying still further) or expansion of the logs (e.g., from the wood taking on additional moisture from the environment) at the preselected destination building site can be mitigated. Furthermore, in some cases, even if some settling in the stack of logs 18 occurs, a building constructed with log wall panels of the present disclosure may be physically prevented from settling due to the top of the pipes (with flanges) having received one or more courses of individually stacked full length "plate logs," the plate logs themselves being supported by the pipes and flanges.

In some implementations, drying the stack of logs 18 to the desired moisture content for the geographic location of the preselected destination building site is performed by regulating the relative humidity of the air within the drying kiln 48 such that the relative humidity is maintained within a normal range of the relative humidity in the air at the geographic location. For example, if the historical annual average high and low relative humidity of the air at the geographic location are 70% and 50%, the vents and fans of the kiln may be opened (e.g., automatically via a computing device) whenever the relative humidity within the drying kiln reaches a humidity value relative to (e.g., exceeds) the upper humidity threshold of 70%, and/or moisture may be added if the relative humidity within the drying kiln reaches a humidity value relative to (e.g., falls below) the lower humidity baseline of 50%. In some implementations, the relative humidity is measured against the upper humidity threshold (but not a lower humidity baseline) such that moisture is not added to the drying kiln; in such implementations, the moisture content of the stack of logs are measured (e.g., via probes) and if the moisture of the wood reaches a moisture content corresponding to an expected moisture content of wood over time at the geographic location, the particular drying stage is determined to be complete.

In 1308, a determination is made (e.g., by an operator or by a computer system communicatively coupled to sensors within the thermally insulated chamber 50 and/or within probes drilled into individual logs of the stack of logs 18) whether the humidity within the thermally insulated chamber 50 has reached a level relative to a first threshold (e.g., exceeds an upper threshold). For example, the probes and/or other sensor within the drying kiln 48 may include a humidity sensor (e.g., capacitive hygrometer, resistive hygrometer, thermal hygrometer, optical hygrometer, etc.) capable of providing measurement of moisture within the wood logs or within the kiln (e.g., to a computing device). If humidity within the thermally insulated chamber has reached the level relative to the first threshold, in 1310, vents and/or fans of the drying kiln 48 may be temporarily opened to allow moist air within the thermally insulated chamber 50 to exit the thermally insulated chamber 50. Thereafter, the entity performing the process 1300 may proceed to 1316.

If the humidity is determined not to exceed the upper threshold, in 1312, a determination is made whether the humidity within the thermally insulated chamber 50 has reached a level relative to a second threshold (e.g., has fallen below a lower threshold). If not, the entity performing the process 1300 may proceed to 1316. Otherwise, if so, in 1314, additional moisture, such as steam from a boiler or preheated tank of water, may be introduced into the thermally insulated chamber 50 in order to raise the humidity within the thermally insulated chamber 50. In this manner, the risk of drying the stack of logs 18 too quickly and causing the individual logs to develop cracks may be mitigated. Thereafter, the entity performing the process 1300 may proceed to 1316.

In 1316, a determination is made whether the drying process is complete. It is noted that there may be multiple stages of the drying process. For example, in a first stage the heat may be a first temperature sufficient cause the stack of logs 18 to dry over a first time (e.g., two days, two weeks, etc.) at a rate suitable to avoid cracking the individual logs by drying the stack of logs 18 too quickly. In a second stage after the moisture content of the stack of logs 18 has dropped below a certain threshold, the heat may be increased to a second temperature over a duration of time suitable to case harden the logs, and/or ensure that any insects and/or fungus is eradicated from the stack of logs 18. If the drying process is incomplete, the entity performing the process may return to 1306 to repeat the operations of 1306-16 as needed. If moisture was vented in 1310, the thermally insulated chamber 50 may have dropped in temperature and additional heat may need to be introduced into the thermally insulated chamber 50 as needed.

Otherwise, if the stack of logs 18 has been dried to a desired/preselected moisture content, the entity may proceed to 1318, whereupon a plurality of upper end flanges (the upper securement members 26) may be attached to the upper end of the plurality of pipes (the elongated connector members 22) extending through the plurality of aligned holes (plurality of aligned apertures) in the stack of logs 18. Because the stack of logs 18 may have decreased in height due to the loss of moisture during the drying and due to the directed force 36 applied in 1304, the plurality of upper end flanges may be tightened down so as to secure the upper end log 14 and prevent the individual logs in the stack of logs 18 from shifting.

In 1320, having secured the plurality of upper end flanges, the directed force 36 may be removed from the upper end log 14, and the stack of logs 18 may be removed from the drying kiln 48. In 1322, finishing procedures, such as the operations 1218-26 of FIG. 12 (e.g., the staining, the chinking 85, and/or installation of the one or more windows 78, the at least one door opening 80, the one or more electrical fixture cutouts 82, or the one or more electrical wiring cutouts 84) may be performed. The result of the operations 1304-22 may be the finished log wall panel 10B. In 1324, the finished log wall panel 10B may be shipped to a preselected destination building site, such as by the transport vehicle 86 in FIG. 10, to be installed in a structure in a manner discussed in reference to FIG. 11 and throughout the present disclosure.

It is noted that one or more of the operations performed in 1302-24 may be performed in various orders and combinations, including in parallel. For example, in some implementations the operations of 1318 and 1320 are reversed. As another example, in some implementations, the finishing procedures of 1322 are omitted.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediate components. Likewise, any two components so associated can also be viewed as being "operably connected," or "operably coupled," to each other to achieve the desired functionality.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms. For example, the use of the terms "a," "an," and "the" and similar referents in the context of describing the disclosed embodiments (especially in the context of the following claims) are to be construed to cover both the singular and the plural, unless otherwise indicated or clearly contradicted by context. Similarly, use of the term "or" is to be construed to mean "and/or" unless contradicted explicitly or by context. The terms "comprising," "having," "including," and "containing" are to be construed as open-ended terms (i.e., meaning "including, but not limited to,") unless otherwise noted.

The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal. The use of the phrase "based on," unless otherwise explicitly stated or clear from context, means "based at least in part on" and is not limited to "based solely on."

Conjunctive language, such as phrases of the form "at least one of A, B, and C," or "at least one of A, B and C," (i.e., the same phrase with or without the Oxford comma) unless specifically stated or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set that has three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set that has {A}, {B}, and/or {C} as a subset (e.g., sets with multiple "A"). Thus, such conjunctive language is not generally intended to imply that certain embodiments require at least one of A, at least one of B and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

It should be further understood that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" or "one or more" to introduce claim recitations. However, the use of such phrases do not imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Accordingly, the invention is not limited except as by the appended claims.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

What is claimed is:

1. A log wall panel, comprising:

a plurality of wood logs arranged to form a vertical stack of horizontally extending logs, an end of a log of the plurality of wood logs including a recess having a longitudinally inwardly positioned sidewall and a longitudinally outwardly positioned sidewall in a confronting relationship, each wood log including a plurality of apertures that form a plurality of vertically aligned apertures in the vertical stack when aligned; and a plurality of connector assemblies connecting the plurality of wood logs together in the vertical stack, wherein each connector assembly of the plurality of connector assemblies extends through a corresponding one of the plurality of vertically aligned apertures.

2. The log wall panel of claim 1 assembled at an assembly site, wherein the log wall panel is pre-assembled at the assembly site to include chinking between the plurality of wood logs.

3. The log wall panel of claim 1 assembled at an assembly site, wherein logs of the log wall panel are pre-assembled at the assembly site to have a moisture content that corresponds to a destination humidity of a preselected destination building site different from the assembly site.

4. The log wall panel of claim 1, wherein each log of the plurality of wood logs is an elongated log with a longitudinal axis and includes wood fibers that are pre-compressed in a downward direction that is transverse to the longitudinal axis.

5. The log wall panel of claim 4, wherein the downward direction is downward to the vertical stack.

6. The log wall panel of claim 1 assembled at an assembly site, wherein the plurality of wood logs arranged in the vertical stack are further pre-assembled at the assembly site include a window cutout or at least a partial door cutout.

7. The log wall panel of claim 6, wherein at least the partial door cutout is located above a lower end log of the vertical stack.

8. The log wall panel of claim 6, wherein a window is installed in the window cutout.

9. The log wall panel of claim 1, wherein:

the vertical stack includes an upper end log and a lower end log; and an individual connector assembly of the plurality of connector assemblies includes:

an elongated connector member having a lower end and a upper end;

a lower securement member attached to the lower end of the elongated connector member to operationally engage the lower end log; and an upper securement member attached to the upper end of the elongated connector member to operationally engage the upper end log.

10. The log wall panel of claim 9, wherein the elongated connector member has a circular cross-section.

11. The log wall panel of claim 9, wherein the elongated connector member is a pipe.

12. The log wall panel of claim 9, wherein the upper securement member is a flange that is attached by being longitudinally fastened onto the elongated connector member.

13. The log wall panel of claim 9, wherein:

a first end portion of one of either the elongated connector member or the upper securement member is internally threaded; and a second end portion of the other one of either the elongated connector member or the upper securement member is externally threaded.

14. The log wall panel of claim 13, wherein the first end portion and the second end portion are removably attached together.

15. A log wall panel, comprising:

a plurality of wood logs arranged to form a vertical stack of horizontally extending logs, each wood log including a plurality of apertures that form a plurality of vertically aligned apertures in the vertical stack when aligned, wherein:

a first log of the plurality of wood logs includes a first main portion that includes a first main edge end, the first main edge end including a first longitudinally outward opening end notch; and a second log of the plurality of wood logs includes a second main portion that includes a second main edge end, the second log being vertically adjacent to the first log, the second main edge end including a second longitudinally outward opening end notch; and a plurality of connector assemblies connecting the plurality of wood logs together in the vertical stack, wherein each connector assembly of the plurality of connector assemblies extends through a corresponding one of the plurality of vertically aligned apertures.

16. The log wall panel of claim 15 for use with an additional log wall panel, wherein:

another log of the additional log wall panel includes another main portion that includes an additional main edge end; and the first longitudinally outward opening end notch fits another non-longitudinally outward opening end notch of the additional main edge end.

17. The log wall panel of claim 15, wherein:

the first log further includes a tail portion that includes a tail end; and the tail end is configured to be detached from the first main portion and has a longitudinally inward opening end notch.

18. The log wall panel of claim 17, wherein the longitudinally inward opening end notch of the tail end is configured to be reattached with a fastener to the first main portion at the first longitudinally outward opening end notch of the first main edge end.

19. The log wall panel of claim 17, wherein:

the first main portion includes another main end;

the first log further includes another tail portion that includes another tail end;

the other main end includes another longitudinally outward opening end notch; and the other tail end has another longitudinally inward opening end notch.

20. A log wall panel, comprising:

a plurality of wood logs arranged along a plane, an individual wood log of the plurality of wood logs including a recess having a longitudinally inwardly positioned sidewall and a longitudinally outwardly positioned sidewall;

a plurality of apertures arranged in a coaxial alignment to form a plurality of coaxially aligned apertures; and a plurality of connector assemblies connecting the plurality of wood logs together in a vertical stack, wherein each connector assembly of the plurality of connector assemblies extends through a corresponding one of the plurality of coaxially aligned apertures, wherein the log wall panel is pre-assembled to have each of the plurality of wood logs include an end notch that fits an end of another log wall panel arranged in another plane transverse to the plane of the plurality of logs of the log wall panel.

21. The log wall panel of claim 20 assembled at an assembly site, wherein the log wall panel at the assembly site is pre-assembled stained with wood stain.

22. The log wall panel of claim 20 assembled at an assembly site, wherein the log wall panel is pre-assembled at the assembly site to include electrical component cutouts.

23. The log wall panel of claim 20, wherein each log of the plurality of wood logs is an elongated log with a longitudinal axis and includes wood fibers that are pre-compressed in a downward direction that is transverse to the longitudinal axis.

24. The log wall panel of claim 23 assembled at an assembly site, wherein the wood fibers in the plurality of wood logs are pre-compressed at the assembly site such that, when arranged along the plane, the plurality of wood logs are at a range of height for a stack of not pre-compressed logs having a same number of logs after at least two years of compression at a preselected destination building site different from the assembly site.

25. The log wall panel of claim 20, wherein:

the plurality of wood logs arranged along the plane includes an upper end log and a lower end log; and each of the plurality of connector assemblies includes:

an elongated connector member having a lower end and a upper end;

a lower securement member attached to the lower end of the elongated connector member to operationally engage the lower end log; and an upper securement member attached to the upper end of the elongated connector member to operationally engage the upper end log.

26. The log wall panel of claim 25, wherein the elongated connector member has a circular cross-section.

27. The log wall panel of claim 25, wherein the upper securement member is attached by being longitudinally fastened onto the elongated connector member.

28. The log wall panel of claim 27, wherein a securing eye member is fastened to an upper portion of the upper securement member.

29. The log wall panel of claim 1, wherein the recess is a saddle notch.

30. The log wall panel of claim 20 assembled at an assembly site, wherein at least some end notches of the plurality of wood logs are saddle notches.

* * * * *